US010786036B2

(12) United States Patent
Cheung

(10) Patent No.: US 10,786,036 B2
(45) Date of Patent: Sep. 29, 2020

(54) MECHANICAL VENTILATION SYSTEM AND DEVICE FOR FOOTWEAR

(71) Applicant: Tak Shun Cheung, Toronto (CA)

(72) Inventor: Tak Shun Cheung, Toronto (CA)

(73) Assignee: Tak Shun Cheung, Toronto (CA)

( * ) Notice: Subject to any disclaimer, the term of this patent is extended or adjusted under 35 U.S.C. 154(b) by 245 days.

(21) Appl. No.: 15/659,565

(22) Filed: Jul. 25, 2017

(65) Prior Publication Data

US 2018/0020769 A1 Jan. 25, 2018

Related U.S. Application Data

(60) Provisional application No. 62/366,431, filed on Jul. 25, 2016.

(51) Int. Cl.

| | |
|---|---|
| ***A43B 7/08*** | (2006.01) |
| ***A43B 13/18*** | (2006.01) |
| *A43B 13/20* | (2006.01) |

(52) U.S. Cl.

CPC ..... *A43B 7/087* (2013.01); *A43B 7/081* (2013.01); *A43B 7/082* (2013.01); *A43B 13/185* (2013.01); *A43B 13/20* (2013.01)

(58) Field of Classification Search

CPC ..... A43B 7/081; A43B 7/082; A43B 7/87; A43B 7/06; A43B 7/146; A43B 13/20; A43B 13/203; A43B 13/206; A43B 13/181; A43B 13/182; A43B 13/185

See application file for complete search history.

(56) References Cited

U.S. PATENT DOCUMENTS

| | | | | |
|---|---|---|---|---|
| 819,449 | A * | 5/1906 | Otterstedt | A43B 7/06 36/3 R |
| 904,891 | A * | 11/1908 | Otterstedt | A43B 7/081 36/3 B |
| 1,870,114 | A * | 8/1932 | Heller | A43B 7/06 36/3 R |
| 4,654,982 | A | 4/1987 | Lee | |
| 5,010,661 | A | 4/1991 | Chu | |
| 5,138,775 | A | 8/1992 | Chu | |
| 5,235,761 | A * | 8/1993 | Chang | A43B 1/0072 36/137 |
| 5,975,861 | A | 11/1999 | Shin et al. | |
| 6,044,577 | A | 4/2000 | Clark | |

(Continued)

OTHER PUBLICATIONS

PCT/US2017/043806, "International Search Report and Written Opinion", dated Oct. 5, 2017, 10 pages.

*Primary Examiner* — Katharine Gracz

(74) *Attorney, Agent, or Firm* — Polsinelli

(57) ABSTRACT

Systems and devices are described for creating a more effective mechanical ventilation system for footwear. For example, a mechanical ventilation system can include an air reservoir that is almost as large as the entire shoe under the footwear's foot bed. In some examples, the air reservoir can be connected to an area that includes a foot of a user in the footwear. The air reservoir can be compressed using a movable part that circulates air in the footwear with every step. The movable part can be relatively small, extending into the air reservoir, and able to compress and inflate the air reservoir. Movement of the movable part can cause a large effective compressible area of the air reservoir to release fresh air near the toes of a foot to flush stale air out of the footwear.

20 Claims, 25 Drawing Sheets

(56) References Cited

U.S. PATENT DOCUMENTS

| | | | | |
|---|---|---|---|---|
| 6,266,898 | B1 | 7/2001 | Cheng et al. | |
| 7,578,074 | B2 | 8/2009 | Ridinger et al. | |
| 7,673,399 | B2 | 3/2010 | Garcia-Perez et al. | |
| 8,555,526 | B2 | 10/2013 | Elnekaveh et al. | |
| 2002/0170203 | A1 | 11/2002 | Sanner | |
| 2004/0154191 | A1* | 8/2004 | Park | A43B 7/081 36/28 |
| 2005/0005473 | A1 | 1/2005 | Oh | |
| 2005/0178023 | A1* | 8/2005 | Hammonds | A43B 7/081 36/3 B |
| 2006/0032082 | A1* | 2/2006 | Lin | A43B 13/182 36/3 B |
| 2007/0209233 | A1* | 9/2007 | Kim | A43B 7/082 36/27 |
| 2008/0189986 | A1 | 8/2008 | Elnekaveh et al. | |
| 2008/0263899 | A1* | 10/2008 | Lee | A43B 7/02 36/102 |
| 2009/0282704 | A1* | 11/2009 | Park | A43B 7/1425 36/3 B |
| 2010/0199517 | A1* | 8/2010 | LeVert | A43B 13/146 36/27 |
| 2011/0167679 | A1* | 7/2011 | Graziani | B29D 35/061 36/3 R |
| 2012/0110871 | A1* | 5/2012 | Elnekaveh | A43B 7/082 36/87 |
| 2012/0260531 | A1* | 10/2012 | Shi | A43B 7/04 36/102 |
| 2014/0223781 | A1* | 8/2014 | Colin | A43B 13/127 36/103 |
| 2015/0157091 | A1* | 6/2015 | Hsu | A43B 13/40 36/44 |

* cited by examiner

MECHANICAL VENTILATION SYSTEM AND DEVICE FOR FOOTWEAR

CROSS-REFERENCES TO RELATED APPLICATIONS

This application claims the benefit of U.S. Provisional Application No. 62/366,431, filed Jul. 25, 2016, the entire disclosure of which is hereby incorporated by reference.

FIELD

The present disclosure relates generally to the ventilation of footwear, and more specifically to a mechanical ventilation system for footwear that produces enhanced airflow with every step.

BACKGROUND

Footwear comes in many different forms, including boots, formal shoes, sneakers, tennis shoes, moccasins, running shoes, sandals, heels, and other suitable forms. Many types of footwear are tight fitting and completely enclosed, which result in a lack of airflow. This lack of airflow can cause stale air to accumulate throughout the day inside of the footwear. To eliminate this problem, designs have been created that refresh the air inside of the footwear, including the addition of membranes to the outside of the footwear and ventilation systems. However, these solutions remain mostly ineffective, creating a need for new ventilation systems that effectively allow air to flow out of footwear.

SUMMARY

Systems and devices are described for creating a more effective mechanical ventilation system for footwear.

For example, a mechanical ventilation system for a piece of footwear may include a sole. The sole may be located at a bottom of the piece of footwear. The sole may be configured to be in contact with a ground or a surface that the piece of footwear is used to walk, run, or stand on. A portion (or a majority) of the sole may be configured to be flexible and deformable by the foot. A majority of the sole may refer to more than 50% of the sole. In some examples, the sole includes a first portion and a second portion, where the first portion of the sole is flexible. In such examples, the first portion of the sole may be thinner than the second portion of the sole so that the second portion can protect the first portion from wear and tear. In other examples, the second portion of the sole is configured to be coupled with a rigid material (e.g., ceramic or engineered plastic) to protect the first portion from wear and tear. In some examples, a portion of the sole is replaceable.

The mechanical ventilation system may further include an air reservoir positioned between a foot bed of the footwear and the sole. The foot bed may be a substantially rigid surface that a foot is in contact with when the foot is inside of the piece of footwear. In some examples, the air reservoir may be an opening that is defined by the foot bed and the sole. The air reservoir may be configured to occupy a majority of the space between the foot bed and the sole. For example, the air reservoir may occupy more than 50% of the space between the foot bed and the sole. In some examples, a portion of the foot bed is configured to be flexible and deformable by the foot.

The air reservoir may include an air intake opening positioned at a heel portion (sometimes referred to as a back portion) of the foot bed and an air exhaust opening positioned at a toe portion (sometimes referred to as a front portion) of the foot bed. The heel portion may be near where a heel of the foot may be located when the foot is inside of the piece of footwear. For example, the heel portion may be a portion between a back of the foot bed and a middle of the foot bed, where the back and the middle are in relation to a length of the piece of footwear. The toe portion may be near where one or more toes of the foot may be located when the foot is inside of the piece of footwear. For example, the toe portion may be a portion between a front of the foot bed and a middle of the foot bed, where the front and the middle are in relation to a length of the piece of footwear. In some examples, the air exhaust opening is a hollow conduit structure leading from a front opening of the air reservoir to a foot compartment of the footwear. In some examples, the air intake opening is a hollow conduit structure leading from a rear opening of the air reservoir to outside of the footwear.

In some examples, the sole may be configured to compress the air reservoir, causing air to flow out of the air exhaust opening when a force is applied by the foot. The sole may be further configured to decompress the air reservoir, causing air to flow into the air intake opening when the force is removed.

The mechanical ventilation system described above may allow a repetitive compression and decompression of the air reservoir to ventilate a foot compartment of the footwear by a flow of air into the air intake opening and out of the air exhaust opening. The foot compartment may be an area of a piece of footwear where the foot is located (sometimes referred to as housed).

The mechanical ventilation system may further include an elastic element coupled to an underside of the foot bed. The underside of the foot bed may be a top side of the air reservoir described above.

In some examples, the mechanical ventilation system may include a connecting juncture between the foot bed and the sole, where a portion of the connecting juncture is flexible and deformable by the foot.

In some examples, the sole is configured to enable peristaltic compression and deflation of the air reservoir when a user wearing the footwear walks and runs. In such examples, peristaltic deflation includes pushing air into the air reservoir using the air intake opening, and peristaltic compression includes bringing outside air into a foot compartment of the footwear using the air exhaust opening, where the outside air replaces stale air inside of the foot compartment to ventilate the foot compartment.

For another example, a mechanical ventilation system can include an air reservoir that is almost as large as the entire shoe under the footwear's foot bed (also interchangeable known as foot platform or substantially rigid surface). In some examples, the air reservoir can be connected to a foot compartment of the footwear that houses a foot of a user. The air reservoir can be compressed using a movable part that circulates air in the footwear with every step. As used herein, the word "movable part" can be referred to as an "actuator." The movable part can be relatively small, extending into the air reservoir, and able to compress and inflate the air reservoir. Movement of the movable part can cause a large effective compressible area of the air reservoir to release fresh air near the toes of a foot to flush stale air out of the footwear. The movable part can be partially or fully under a substantially rigid surface, such as the footwear's foot bed, allowing for movement of the movable part while still providing support for the foot with the substantially rigid surface. In some embodiments, when the movable part is compressed, depressed, or pushed in a downward direction, the movable part can force air out of the air reservoir through an exhaust opening near the toes of the foot, flushing bad or stale air out through the top of the footwear. The rear portion of a foot (e.g., a heel of the foot) can apply the force, pressure or weight, to compress (or depress) the movable part.

Provided are mechanical ventilation systems for footwear. In some implementations, a mechanical ventilation system can include an air reservoir positioned between a foot bed of the footwear and a sole of the footwear. In some examples, the air reservoir can include an air intake opening and an exhaust opening, each connected to a foot compartment of the footwear. In such examples, the foot compartment can be configured to house a foot of a user.

The mechanical ventilation system can further include an actuator (sometimes referred to herein as a movable part). The actuator can be configured to be depressible when weight is applied to the actuator. A portion of the actuator can extend into the air reservoir such that movement of the actuator facilitates at least one or more of intake of air into the air reservoir through the air intake opening and exhaust of air out of the air reservoir through the exhaust opening. A portion of the actuator can be positioned to be depressible by a heel of the foot, a ball of the foot, another area of the foot, or any combination thereof.

In some examples, the actuator (or movable part) can include a front actuator portion and a rear actuator portion. In such examples, the front actuator portion can be positioned to be depressible by a ball of the foot, and the rear actuator portion can be positioned to be depressible by a heel of the foot. In some examples, when the rear actuator portion is depressed in a downward direction by the heel of the foot, the air intake opening of the air reservoir can be at least partially sealed and movement of the actuator can force air to flow in a direction from the rear actuator portion toward the front actuator portion and out of the exhaust opening of the air reservoir.

In some examples, when the front actuator portion is compressed in a downward direction by the ball of the foot while the rear actuator portion is compressed in the downward direction by the heel of the foot, the exhaust opening of the air reservoir can be at least partially sealed and the actuator can overcome the force of the elastic element to cause the actuator to move in a downward direction, forcing air to flow in a direction from the rear actuator portion toward the front actuator portion and out of the exhaust opening of the air reservoir. In some examples, when the rear actuator portion is uncompressed in an upward direction while the front actuator portion is compressed in a downward direction, the air intake opening of the air reservoir can be at least partially unsealed, allowing air to flow into the air reservoir. In some examples, when the rear actuator portion is uncompressed in an upward direction and the front actuator portion is uncompressed in an upward direction, the air intake opening of the air reservoir can be open, allowing air to flow into the air reservoir In some implementations, the mechanical ventilation system can further include one or more elastic elements. In some examples, an elastic element can be coupled to an underside of the actuator. In such examples, an additional elastic element can also be coupled to the underside of the actuator. In some examples, the additional elastic element can be located in a different position than the elastic element.

In some implementations, the actuator can further include an additional extension portion. In such implementations, the additional extension portion can be coupled to at least one or more of the front actuator portion and the rear actuator portion. In some examples, the additional extension portion can be located at least partially under a substantially rigid surface, creating an additional air reservoir. In some examples, the substantially rigid surface can be separate from the foot bed. In such examples, at least one of the front actuator portion and the rear actuator portion can each include an interior hollow region that connects the air reservoir and the additional air reservoir.

In some implementations, a mechanical ventilation system can include a substantially rigid surface. In such implementations, the substantially rigid surface can be configured to support at least a portion of a foot. The mechanical ventilation system can further include a movable part that includes a front actuator portion, an extension portion, and a rear actuator portion. In some examples, the front actuator portion can be positioned at a front portion of the footwear. In such examples, the front actuator portion can be compressible in an upward direction by a surface. In some examples, the extension portion can be located at least partially under the substantially rigid surface. In some examples, the rear actuator portion can be positioned at a rear portion of the footwear. In such examples, the rear actuator portion can be compressible in the upward direction by the surface.

In some implementations, the mechanical ventilation system can further include (1) an elastic element coupled to the movable part and the substantially rigid surface and (2) an air reservoir. In some examples, the air reservoir can include an air intake opening and an exhaust opening. In some examples, when the rear actuator portion is compressed in the upward direction, the air intake opening of the air reservoir can be at least partially sealed and the extension portion can overcome a force of the elastic element to cause the extension portion to move in the upward direction, forcing air to flow in a direction from the rear actuator portion toward the front actuator portion and out of the exhaust opening of the air reservoir.

In some implementations, the mechanical ventilation system can be included in a shoe. The shoe can include a front actuator portion, an extension portion, and a rear actuator portion. The front actuator portion can be positioned at a front portion of the sole. In some examples, the front actuator portion can be compressible in an upward direction by a surface (e.g., the ground). In some examples, the extension portion can be located at least partially under a substantially rigid surface. In such examples, the substantially rigid surface can be configured to support at least a portion of a foot. In some examples, the rear actuator portion can be positioned at a rear portion of the sole. In such examples, the rear actuator portion can be compressible in the upward direction by the surface.

In some implementations, the shoe can further include an elastic element coupled to the sole and the substantially rigid surface. In some examples, the shoe can further include an air reservoir. In such examples, the air reservoir can include an air intake opening and an exhaust opening.

In some examples, when the rear actuator portion is compressed in the upward direction, the air intake opening of the air reservoir can be at least partially sealed and the extension portion can overcome a force of the elastic element to cause the extension portion to move in the upward direction, forcing air to flow in a direction from the rear actuator portion toward the front actuator portion and out of the exhaust opening of the air reservoir.

In some implementations, a mechanical ventilation system for footwear can include an air reservoir positioned between a foot bed of the footwear and a sole of the footwear. In such examples, the air reservoir can include an air intake opening and an exhaust opening connected to a foot compartment of the footwear. In some examples, the foot compartment can be configured to house a foot of a user. In some examples, the mechanical ventilation system can further include a sole. In such examples, the sole can be configured to compress the air reservoir when the user wearing the footwear steps on a surface with the footwear. In some examples, the sole can be configured to decompress the air reservoir when the user wearing the footwear lifts the footwear from the surface. In such examples, the movement of the sole repetitively expands and contracts a volume of the air reservoir to ventilate the foot compartment.

In some implementations, the mechanical ventilation system of claim can further include an elastic element coupled to an underside of the foot bed. In some examples, a portion of the sole is configured to be flexible and deformable by the foot of the user. In some implementations, the mechanical ventilation system can further include a connecting juncture between the foot bed and the sole. In such implementations, a portion of the connecting juncture can be flexible and deformable by the foot of the user. In some examples, a portion of the foot bed can be configured to be flexible and deformable by the foot of the user.

In some implementations, the sole can be configured to enable peristaltic compression and deflation of the air reservoir when the user wearing the footwear is pressed against a surface (e.g., when walking or running). In such implementations, peristaltic deflation can include pushing air into the air reservoir using the air intake opening, and peristaltic compression can include bringing outside air into the foot compartment using the exhaust opening. In some examples the outside air can replace stale air inside of the foot compartment to ventilate the foot compartment.

In some implementations, the sole can include a first portion and a second portion. In such implementations, the first portion of the sole can be flexible. In some examples, the first portion of the sole can be thinner than the second portion of the sole. In some examples, the second portion can be configured to be thicker than the first portion to protect the first portion from wear and tear against a surface. In such examples, the second portion of the sole can be replaceable.

In some examples, the sole can include a first portion and a second portion. In such examples, the first portion of the sole can be flexible and configured to be coupled with a rigid material (e.g., ceramic or engineered plastic) to protect the first portion from wear and tear against a surface. In such examples, the second portion of the sole can be replaceable.

In some implementations, the exhaust opening can be a hollow conduit structure leading from a front opening of the air reservoir to the foot compartment. In some examples, the air intake opening can be a hollow conduit structure leading from a rear opening of the air reservoir to outside of the footwear.

In other embodiments, a mechanical ventilation system for footwear can include a movable part that comprises one or more actuator portions (or contact areas) that are affected or actuated by a foot of a user. The movable part can also include an "extension," or "extension portion," that extends the air reservoir under the foot bed (which can be a substantially rigid surface). The one or more actuator portions can be compressed, depressed, or moved in a downward direction by different portions of a foot. In some embodiments, one or more portions of the movable part can be held against the foot bed, a substantially rigid surface, by one or more elastic elements that are designed to compress when a downward force of a foot is applied to such portions of the movable part. The terms compress and depress can be used interchangeable in this specification.

In some examples, when a user takes a step, the heel of the foot can cause the footwear to strike the walking surface (e.g., the ground or other surface upon which a user walks). During a heel strike, a back portion of the foot can cause an actuator portion (e.g., a rear contact area) of the movable part to compress (or lower/depress) and overcome a force of one or more elastic elements. Compression or depression of the actuator can cause an intake opening of an air reservoir to be at least partially eliminated, and also cause an extension of the movable part to move in a downward direction in the air reservoir. The downward movement of the extension and the actuator can force air to flow in a direction from the extension toward an exhaust opening of the air reservoir in the front of the footwear. When the footwear is then brought to a neutral position as the user continues the step (e.g., the front of the footwear comes in contact with the walking surface along with the back of the foot), the movable part can be depressed or lowered in the air reservoir as the force of the one or more elastic elements is overcome by the foot, causing any remaining air in the air reservoir to be released through the exhaust opening.

When the ankle of the foot is then lifted to raise the heel or back portion of the footwear off of the walking surface, the movable part can raise in an upward direction to resume its natural state, which opens the intake opening. In such cases, the movable part might not be compressed or depressed. The opening of the intake opening can allow fresh air to fill the air reservoir with fresh air and the process repeats.

In some embodiments, one or more partially hollow portions can be used to allow for multiple levels of air reservoirs to minimize a depth that the movable part must travel to displace a particular amount of air. An embodiment can have multiple portions under multiple substantially rigid surfaces to allow for the amount of air moved to be approximately equal to a change in distance by the movable part multiplied by each level.

In some embodiments, the sole can be made with a flexible material and can be sized almost as large as the shoe such that it can be used to compress or inflate a large area of the air reservoir with a relatively small vertical travel, and there is still substantial air movement inside the shoe for ventilation. In some embodiments, the sole can be flexible to bring in movement of air from outside to inside in a substantially single direction by peristaltic compression and inflation of the air reservoir when the user is walking or running.

This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

The foregoing, together with other features and embodiments, will be described in more detail below in the following specification, claims, and accompanying drawings.

BRIEF DESCRIPTION OF THE DRAWINGS

Illustrative embodiments of the present invention are described in detail below with reference to the following drawing figures.

DETAILED DESCRIPTION

In the following description, for the purposes of explanation, specific details are set forth in order to provide a thorough understanding of embodiments of the disclosure. However, it will be apparent that various embodiments may be practiced without these specific details. The figures and description are not intended to be restrictive.

The ensuing description provides exemplary embodiments only, and is not intended to limit the scope, applicability, or configuration of the disclosure. Rather, the ensuing description of the exemplary embodiments will provide those skilled in the art with an enabling description for implementing an exemplary embodiment. It should be understood that various changes may be made in the function and arrangement of elements without departing from the spirit and scope of the disclosure as set forth in the appended claims.

Footwear often lacks effective airflow when worn by users, causing stale air to accumulate inside the footwear. Many footwear designs attempt to eliminate this problem by adding membranes to the outside of the footwear and ventilation systems that constantly refresh the air inside of the footwear. Unfortunately, membranes are not always possible, including when the footwear must be sealed to the outside. Ventilation systems are either powered electronically or mechanically. An example of an electronic ventilation system is a built-in miniature fan that is powered by batteries. However, such a design may not be suitable for hazardous environments, including when gas leaks are present. Furthermore, electronic ventilation systems may malfunction, leaving the systems inoperable.

Figure 1A:
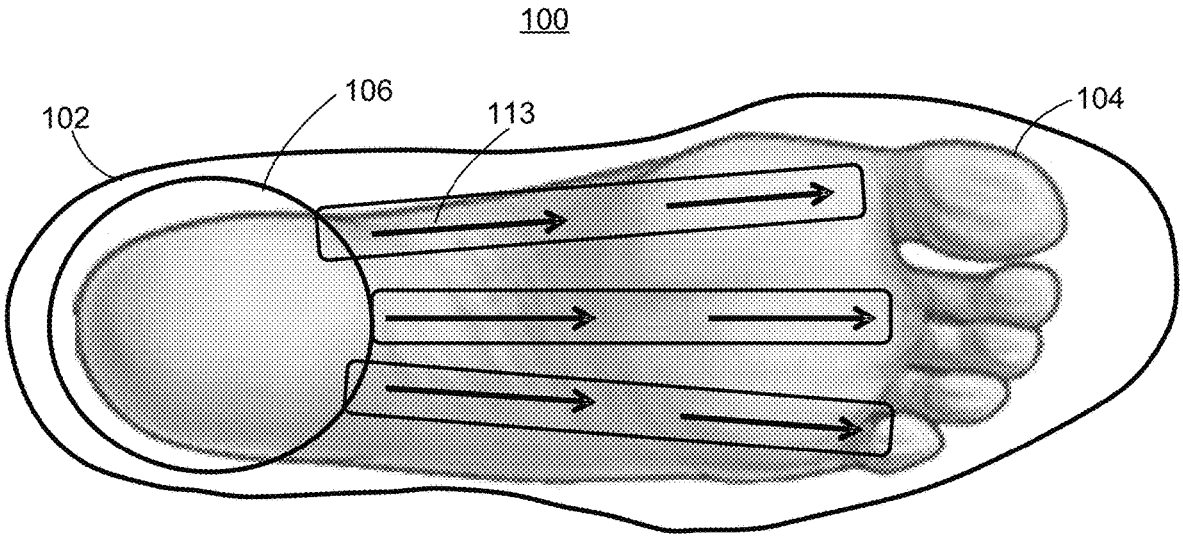
FIG. 1A is a bottom view illustrating an example of a mechanical ventilation system for footwear.

Mechanical ventilation systems can provide a more effective system to allow air to flow out of footwear. FIG. 1A illustrates a bottom view showing an example of a mechanical ventilation system 100 for an item of footwear 102. As shown, a foot 104 can be inside a foot compartment of footwear 102. The mechanical ventilation system 100 can include an actuator 106. The actuator 106 can be located near a heel of the foot 104. The actuator 106, when depressed, can transfer air to the front of the footwear 102. In particular, when the foot 104 presses on the actuator 106, air can travel in the direction shown by the arrows. In addition, the air can be directed through one or more rigid channels 113 when the actuator 106 is activated. The one or more rigid channels 113 can support the foot 104. The system in FIG. 1A can have limited effectiveness because the volume of the air displaced can be just the size of the actuator 106 (e.g., due to only the region of the actuator 106 around the heel being compressible).

Figure 1B:
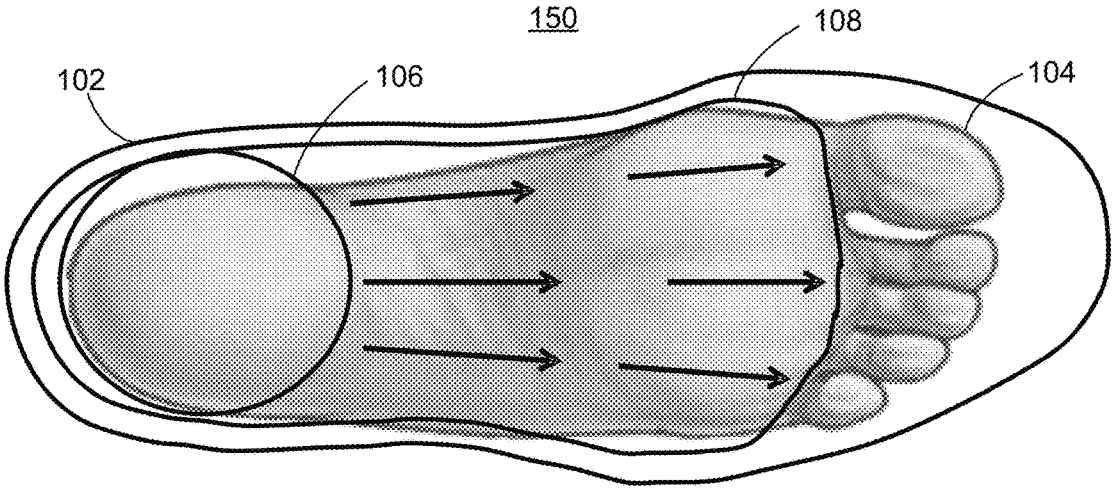
FIG. 1B is a bottom view illustrating another example of a mechanical ventilation system for footwear, in accordance with an embodiment of the present disclosure.

Mechanical ventilation systems can be improved by using space between the foot bed and the sole of the footwear to collect air, circulate air, and ventilate the foot compartment of the footwear. FIG. 1B is a bottom view illustrating another example of a mechanical ventilation system 150 for footwear, in accordance with an embodiment of the present disclosure. The footwear includes air reservoir 108 positioned between the foot bed and the sole for collecting air and circulating air to the foot compartment. The actuator 106 can be connected to an extension that extends across the air reservoir 108. The extension can increase the area that is displaced when the actuator 106 is compressed, depressed, or lowered. In such examples, the actuator is not confined to moving air directly under the heel of the foot 104. When weight is applied to the actuator 106, the actuator 106 is compressed (sometimes referred to as depressed). Movement of the actuator 106 and the extension (which extends into the air reservoir 108) displaces air in the air reservoir 108. Therefore, when the actuator 106 is lowered, the air can come from under both the actuator 106 and the extension. The displaced air can then exit between the toes of the foot 104, which is an area where ventilation is desired. As can be seen, the air displaced is much larger in the mechanical ventilation system 150 as compared the mechanical ventilation system 100, and is thus more effective.

Figure 2:
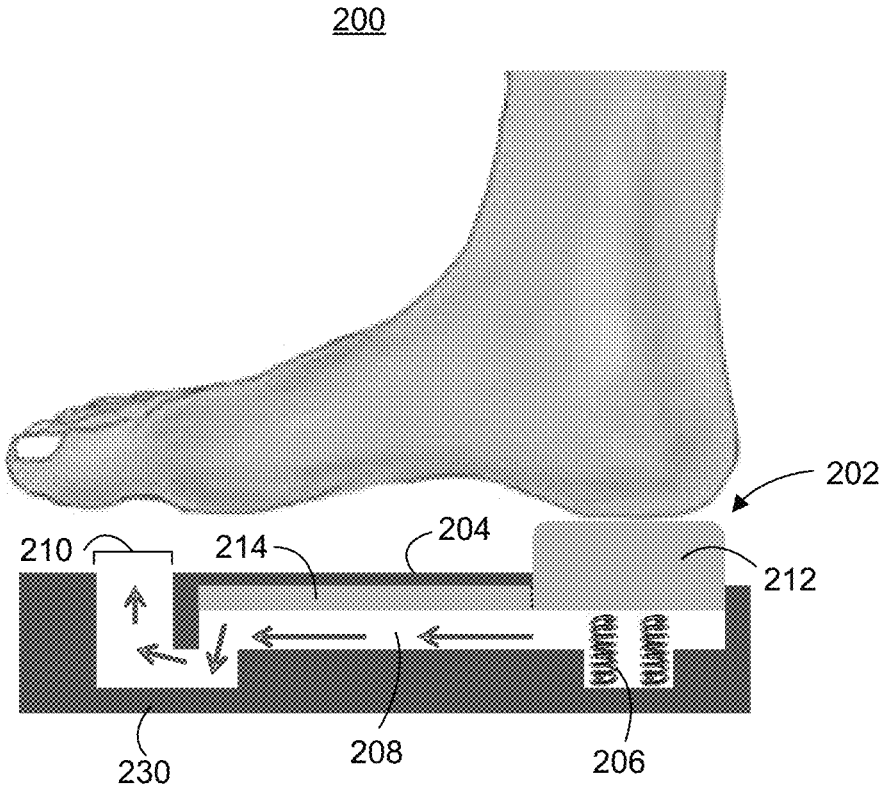
FIG. 2 is a side view illustrating an example of a mechanical ventilation system with an actuator near a back of a footwear, in accordance with an embodiment of the present disclosure.

FIG. 2 is a side view illustrating an example of a mechanical ventilation system 200 for footwear, in accordance with an embodiment of the present disclosure. The mechanical ventilation system can include an air reservoir 208 and a movable part 202. The air reservoir 208 can be positioned between a foot bed 204 (interchangeable a substantially rigid surface) and a sole 230 of the footwear. For example, the air reservoir 208 may be a space that is defined by the foot bed 204 and the sole 230. The sole 230 may be a section forming an underside of a piece of footwear (sometimes including a heel when the heel forms a distinct part). For example, the sole 230 may include a bottom portion of the piece of footwear that is in contact with a ground or surface while the footwear is being used to walk or run on. The movable part 202 can be mobile. The movable part 202 can include an extension portion 214 that can extend into the air reservoir 208 and be at least partially covered by the foot bed 204. The movable part 202 can further include an actuator 212 (or contact area). One of skill in the art will appreciate that the movable part 202 can be a different size or shape than that shown in FIG. 2. In addition, movable part 202 can be covered more or less by the foot bed 204 than that shown. While FIG. 2 illustrates a top of the actuator 212 above the foot bed 204, the top of the actuator 212 can be level with the foot bed 204 in some embodiments. In other embodiments, the actuator 212 can raise above the foot bed 204 in more than one place. In other embodiments, the actuator 212 can be located in a different location than shown in FIG. 2. For example, the actuator 212 can be located near the center of the footwear. The actuator 212 can also be located in other portions of the footwear (e.g., near the front of the footwear).

The foot bed 204 can be rigid, providing an area that the foot can rest upon while the movable part 202 remains mobile. As used herein, the term rigid (or "substantially rigid") can refer to a surface that provides foot support to a user and that does not substantially alter shape when the user applies the force of their body weight to the surface. For example, the foot bed 204 may move slightly in a downward direction when the user is standing on the foot bed 204, but does not move or alter shape so much that the user is not provided with foot support. For example, the foot bed 204 can provide the support that the sole 230 of a typical item of footwear provides. The area under the foot bed 204, the extension portion 214, and the actuator 212 can include an air reservoir 208. When a user takes a step, the force of the foot can compress the actuator 212 and push the extension portion 214 downward. The operation of the actuator 212, the extension portion 214, and the air reservoir 208 can allow for more air to be displaced, which provides better ventilation. By using the combination of the actuator 212, the extension portion 214, and the air reservoir 208, the mechanical ventilation system 200 can have access to more displaced air when the movable part 202 is activated. In addition, the mechanical ventilation system 200 can achieve improved exit velocity of the displaced air in relation to where fresh air is needed. The improved exit velocity can be achieved because the air is displaced from a location near the toes.

The movable part 202 can be raised in an upward direction by an elastic element 206 when the foot is lifted up and the actuator 212 is not under a force that opposes gravity. When the movable part 202 is raised in an upward direction, air can fill the air reservoir 208 through an air intake opening (or "intake opening") (illustrated as air intake opening 303 in FIG. 3A, but not illustrated in FIG. 2). The air intake opening may be positioned in a heel portion of the foot bed, the heel portion where a heel of a foot would be located when the foot is inserted into a piece of footwear. The heel portion may be between a side of the foot bed that is located at the back of the piece of footwear and a middle of the foot bed relative to a front and a back of the footwear. The elastic element 206 can provide enough force to push the movable part 202 toward, or in contact with, the foot bed 204 when the foot is lifted. In some examples, the elastic element 206 can include a metal helical spring. However, while the elastic element 206 is shown as a metal helical spring in FIG. 2, the elastic element 206 can include any elastic element that provides a force to the movable part 202 in an upward direction, as described above. Examples of elastic elements can include, but are not limited to, a spring (e.g., metal, plastic, or springs made of other suitable materials), magnets, memory foams, or any other elastic or resistive material or item. The elastic element 206 can also be located in a different location than shown in FIG. 2. For example, the elastic element 206 can be located toward the middle of the movable part 202. Further, while two elastic elements are shown in FIG. 2, a single elastic element, or more than two elastic elements, can be provided to apply an upward force to the movable part 202. In such an example, the force provided by the elastic elements would be split among the number of elastic elements. The elastic element 206 can also be bigger or smaller than shown in FIG. 2.

Once the foot moves in a downward direction, the actuator 212 and the extension portion 214 of the movable part 202 can overcome the force of the elastic element 206 and move in a downward direction. When the movable part 202 is moved in the downward direction by the foot, air can be pushed through the air reservoir 208 along the path indicated by the arrows shown in FIG. 2. The air eventually can be released at an exhaust opening 210 (or air exhaust opening) that is located near the toes of the foot. The location of the exhaust opening 210 can be near the front of the footwear. For example, the exhaust opening 210 may be positioned in a toe portion of the foot bed, the toe portion where toes of a foot would be located when the foot is inserted into a piece of footwear. The toe portion may be between a side of the foot bed that is located at the front of the piece of footwear and a middle of the foot bed relative to a front and a back of the footwear.

The path and size of the exhaust opening 210 can be different than that shown in FIG. 2. For example, the path can be narrower or wider than shown, or the path can be straight or have one or more bends in it to account for the shape of certain footwear. In addition, the exhaust opening 210 can be located in a different place in the footwear, or can be narrower or wider than that shown.

Figure 3A:
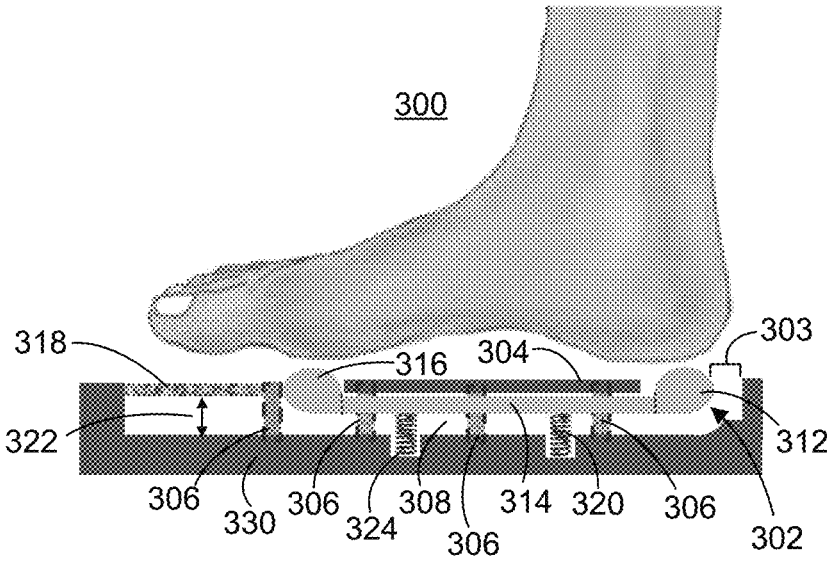
FIG. 3A is a side view illustrating another example of a mechanical ventilation system for footwear in a neutral position, in accordance with an embodiment of the present disclosure.
Figure 7:
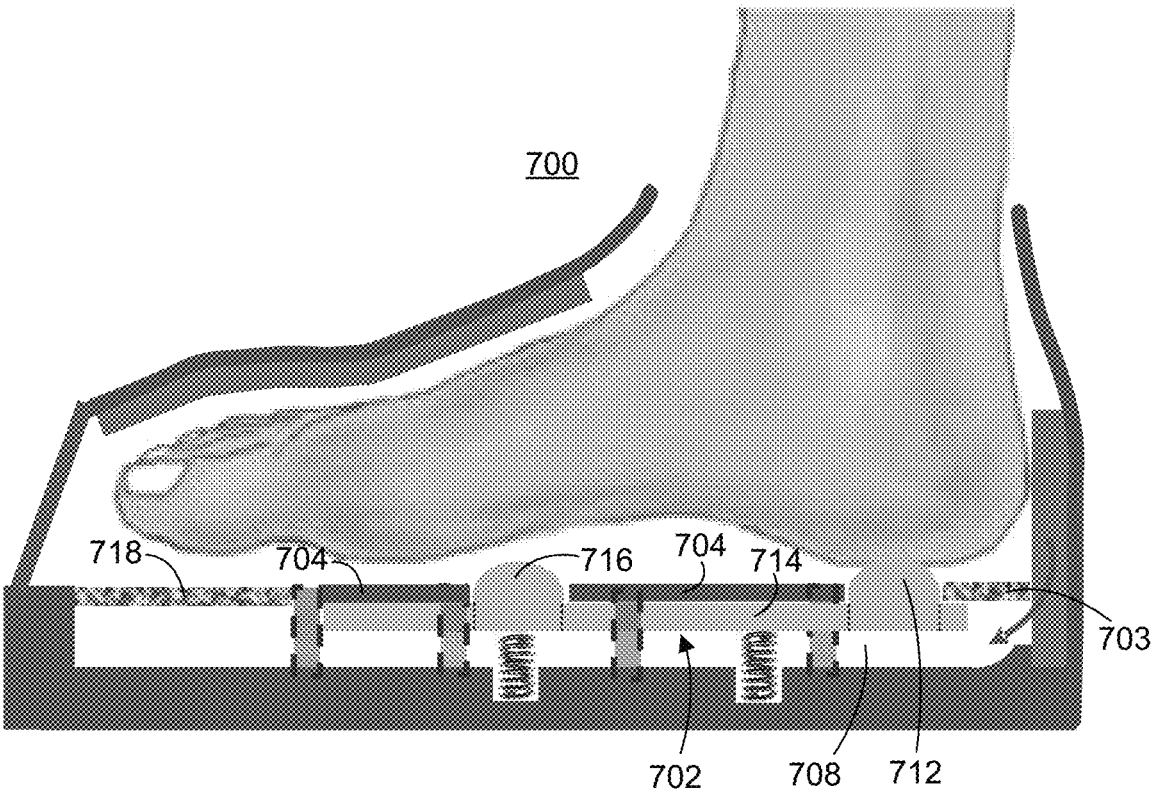
FIG. 7 is a side view illustrating an example of a mechanical ventilation system with different locations for portions of a movable part in a single direction air flow mechanism, in accordance with an embodiment of the present disclosure.

In some embodiments, a movable part, similar to the movable part 202 in FIG. 2, can include more than one actuator as illustrated in FIG. 3A. FIG. 3A is a side view illustrating another example of a mechanical ventilation system 300 for footwear in a first (neutral) position, in accordance with an embodiment of the present disclosure. The footwear can house a foot resting on a substantially rigid surface 304. While the substantially rigid surface 304 can move nominally due to the materials it is made of, a purpose of the substantially rigid surface can be to provide support for the foot. Thus, any movement or compression of the substantially rigid surface can be due to the materials involved and not because the substantially rigid surface 304 is meant to displace air for the mechanical ventilation system 300. The rigidity of the substantially rigid surface 304 can be important to provide stability for the footwear. For example, the footwear can be worker's boots, in which case a person might climb ladders. In such an example, a fixed foot platform can be advantageous compared to a compressible platform. However, some compression is inevitable, due to the nature of materials and for purposes such as cushioning to provide comfort for the user of the footwear. In addition, the substantially rigid surface 304 can be more than one contiguous surface. For example, the substantially rigid surface 304 can be broken up into pieces or segments that still support the foot, as shown in FIG. 7.

The mechanical ventilation system 300 can also include a movable part 302. The movable part 302 can include a front actuator portion 316 and a rear actuator portion 312. The front actuator portion 316 and the rear actuator portion 312 can be compressible (e.g., in a downward direction). The movable part 302 can also include a middle section, referred herein as an extension portion (or an "extension 314"). The extension 314 can be located under the substantially rigid surface 304. However, one of skill in the art will appreciate that the extension 314 can be located in a different position, not under the substantially rigid surface 304. In other embodiments, the extension 314 can be located a greater or lesser amount under the substantially rigid surface 304. In some embodiments, the mechanical ventilation system 300 can provide stability to a user because the rear actuator portion 312 and the front actuator portion 316 are relatively small parts in contact with the user of the footwear. The rear actuator portion 312 and/or the front actuator portion 316 can be padded with soft materials to function as cushion for a foot. The depth that the movable part 302 can lower can depend on a z-depth 322. The z-depth 322 can be optimized for a reasonable air flow while not creating an excessive movement of the rear actuator portion 312 and/or the front actuator portion 316. In some embodiments, an illustrative z-depth can range from 0.5 mm to 5 inches. One of ordinary skill in the art will appreciate that the movable part 302 can lower to other suitable z-depths.

The substantially rigid surface 304 can be supported by a series of columns 306. The columns 306 can be coupled to a foot bed 330, as shown in FIG. 3A. In some embodiments, the substantially rigid surface 304 can be supported by a side or wall of the footwear instead of a column, as will be described further below. In some examples, the columns 306 can be hollow to allow ventilation of air to an area between the substantially rigid surface 304 and a foot. In some examples, to fit the movable part 302 around the columns 306, the movable part 302 can include holes where the columns 306 are located to facilitate movement of the movable part 302 in upward and downward directions. In other examples, the columns 306 can be positioned such that they do not interfere with the movement of the movable part 302.

Similar to the system shown in FIG. 2, one or more elastic elements 320 and 324 (similar to the elastic element 206) can provide tension for the movable part 302 (similar to the movable part 202) in an upward direction. Elastic elements 320 and 324 can have elastic and/or pivoting properties. As seen in FIG. 3, two separate elastic elements 320 and 324 can be positioned in different locations. By having two elastic elements 320 and 324, with some distance between them along the extension 314, actuators 312 and 316 can move independently as force is applied to the movable part 302. However, one of skill in the art will appreciate that the particular locations of the elastic elements 320 and 324 can be changed, or that the number of elastic elements can either be increased or decreased depending on the particular type of elastic element and the amount of force required to oppose gravity.

The mechanical ventilation system 300 can further include an exhaust opening 318 that can allow the free flow of air both while the movable part 302 is lowered and while the movable part 302 is not operating (e.g., when the person is not walking). Air is allowed to enter the mechanical ventilation system 300 through an intake opening 303, where the rear actuator portion 312 can at least partially close. The mechanical ventilation system 300 can be designed so that the air travels through the mechanical ventilation system 300 until it reaches the exhaust opening 318, where air can exit towards the toes of the foot. The exhaust opening 318 can include an air-permeable surface through which air can escape. Examples of an air-permeable surface can include, but are not limited to, a mesh screen, a surface with holes, a membrane that allows the free flow of air, or any other material or element that allows air through but will also act as a surface for a foot's toes to rest on. The area of the exhaust opening 318 can be any material. In other embodiments the exhaust opening can be an open orifice for air to escape.

FIG. 3B-FIG. 3E show further side views of the mechanical ventilation system 300, in accordance with an embodiment of the present disclosure. The different views shown in FIG. 3B-FIG. 3E illustrate a user during a walking motion. The movable part 302, together with the movement during walking, enables a single direction air-flow, without the use of air valves commonly found in prior designs. This single direction air-flow mechanism is explained by dividing the walking movement into four positions.

Figure 3B:
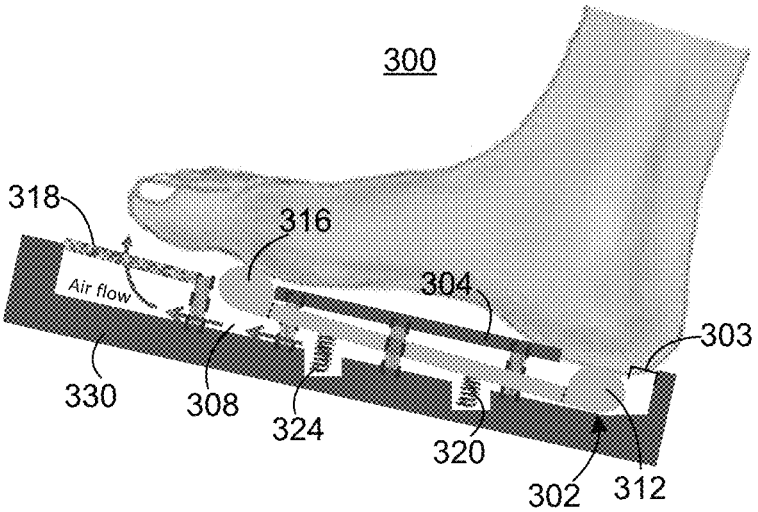
FIG. 3B is a side view illustrating another example of a mechanical ventilation system for footwear in a first position, in accordance with an embodiment of the present disclosure.

The first position is illustrated by FIG. 3B, which shows the beginning of the walking movement when the heel of a user's foot presses against the walking surface with the front of the foot slightly raised off of the walking surface (referred to herein as a "heel strike"). During the heel strike, the rear portion of the foot (e.g., the heel and/or other rear portion of the user's foot) causes the rear actuator portion 312 of the movable part 302 to lower to the foot bed 330. In some embodiments, by lowering the rear actuator portion 312 to the foot bed 330, the intake opening 303 can be closed off to the free flow of air. The elastic element 320, which is closer to the rear actuator portion 312 than the elastic element 324, can be compressed more than the elastic element 324, which is closer to the front actuator portion 316. The use of both elastic elements 320 and 324 divides the force applied to each elastic element 320, 324 between the two, lessening the work of each individual elastic element 320, 324. In addition, each elastic element 320, 324 has less torque applied to it as compared to if it were the only elastic element coupled to the movable part 302.

Lowering of the rear actuator portion 312 can cause fresh air to flow through an air reservoir 308 in a direction from the rear actuator portion 312 to the front of the footwear toward the exhaust opening 318. As the rear actuator portion 312 is lowered (or "compressed"), the front actuator portion 316 can be raised upward toward the substantially rigid surface 304. By raising the front actuator portion 316, the air flowing through the air reservoir 308 can escape through the exhaust opening 318 near the toes of a foot.

Figure 3C:
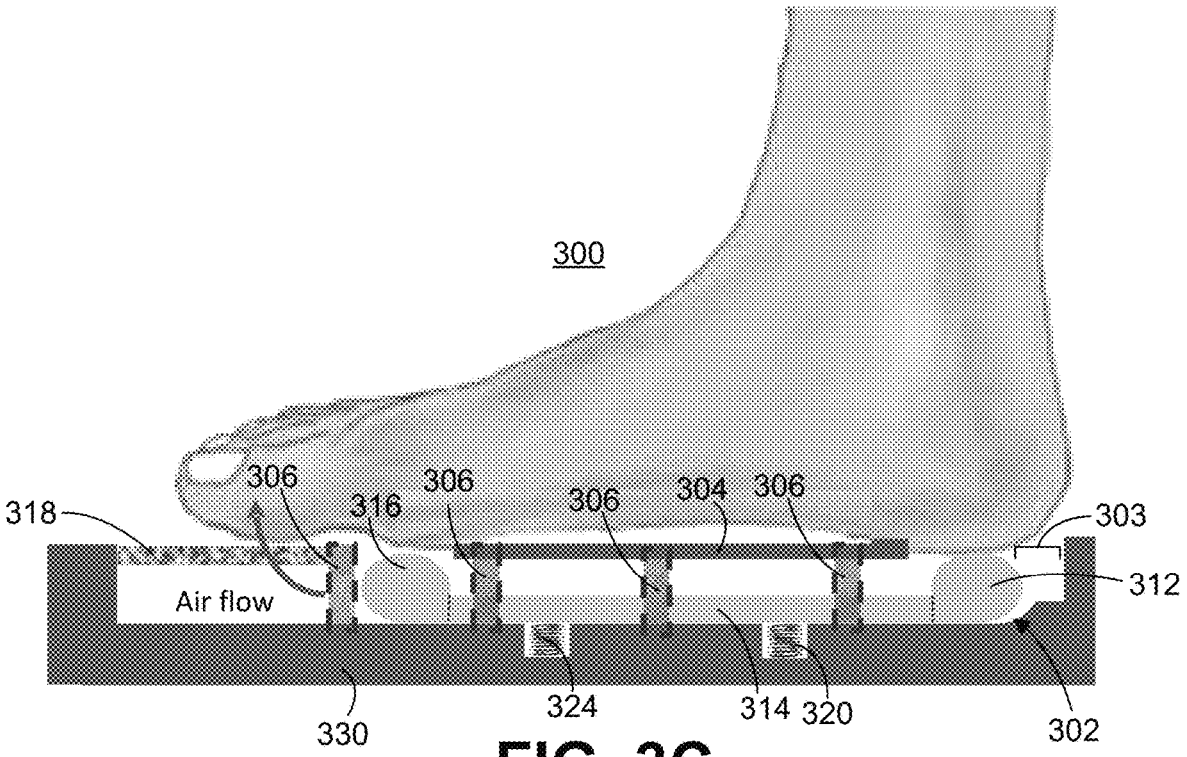
FIG. 3C is a side view illustrating another example of a mechanical ventilation system for footwear in a second (neutral) position, in accordance with an embodiment of the present disclosure.

The second position is illustrated by FIG. 3C, which shows the foot pressing the entire footwear to the walking surface. When the entire footwear is pressed to the walking surface, the mechanical ventilation system 300 can be put in a lowered position, where the rear actuator portion 312, the extension 314, and the front actuator portion 316 are lowered to the foot bed 330. In addition, the elastic elements 320, 324 can be compressed. When this occurs, the intake opening 303 continues to be closed by the rear actuator portion 312. The remaining amount of air under the extension 314 can be forced out from the air reservoir 308 toward the front of the footwear through the exhaust opening 318. In some embodiments, as described above, the columns 306 can be hollow. In such embodiments, air can travel from the air reservoir 308, through the columns 306, and to a middle area of the footwear through the columns 306 to further ventilate the foot. In some embodiments, when the movable part 302 of the mechanical ventilation system 300 is in the lowered position, a gap can be created between the movable part 302 and the substantially rigid surface 304. For example, the gap can be present because the movement of the movable part 302 does not require the substantially rigid surface 304 to move. As previously described, the substantially rigid surface 304 can be somewhat movable to allow for cushioning, but any vertical movement of the rigid surface 304 is less as compared to the movable part 302.

Figure 3D:
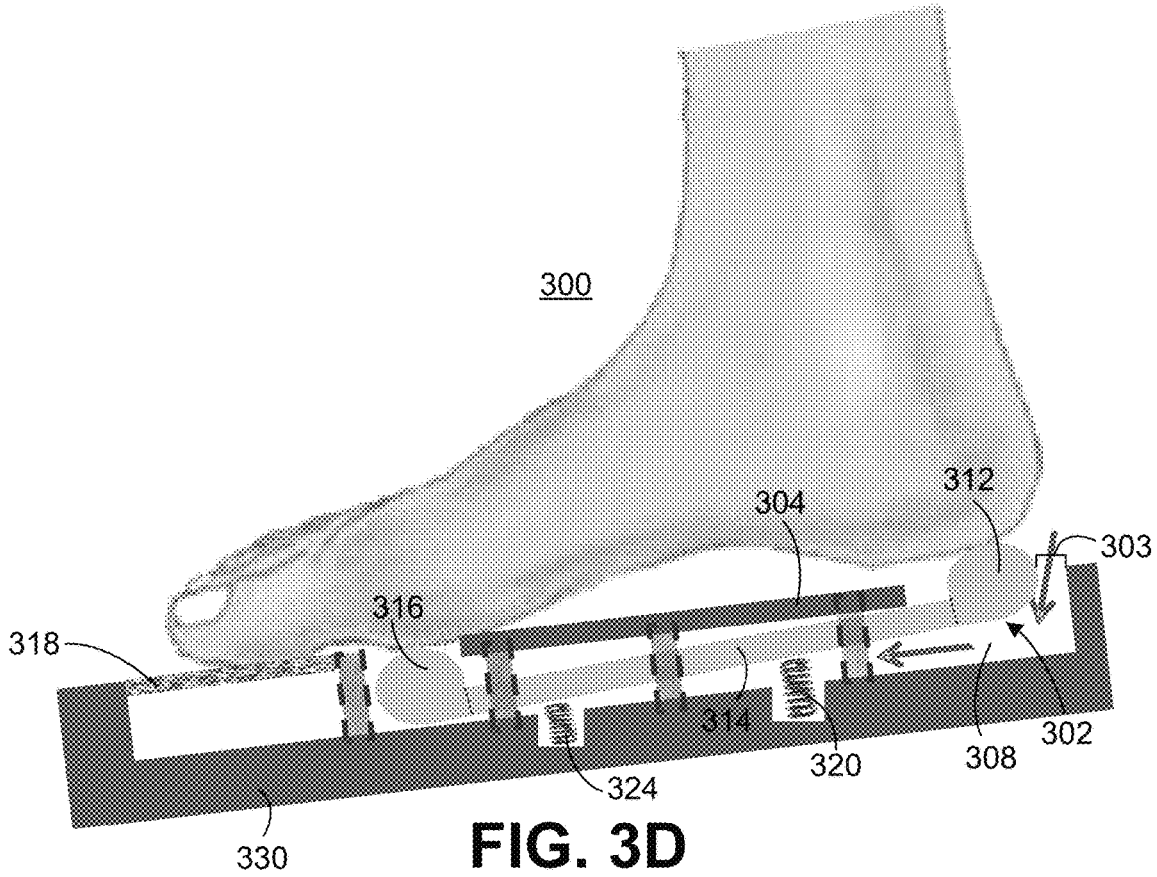
FIG. 3D is a side view illustrating another example of a mechanical ventilation system for footwear in a third position, in accordance with an embodiment of the present disclosure.

The third position, illustrated by FIG. 3D, is the foot lifting up at the ankle, leaving the front of the foot on the walking surface and the heel lifted from the walking surface. When the user lifts up the foot at the ankle, the rear actuator portion 312 can be caused to move in an upward direction from the foot bed 330. In such an example, the front actuator portion 316 can continue to be lowered toward or in contact with the foot bed 330. The upward movement of the rear actuator 312 can cause the intake opening 303 to open. In addition, a portion of the air reservoir 308 can be shut off by the front actuator portion 316, preventing air from escaping through the exhaust opening 318. As a result of the exhaust opening 318 being shut-off from the air reservoir 308, stale air can be prevented from flowing back into the air reservoir 308. While the exhaust opening 318 is shut-off, the air reservoir 308 can be refilled by fresh air that is allowed to enter into the air reservoir 308 through the intake opening 303. In such an example, the elastic element 324 can be fully compressed while the elastic element 320 can be either at least partially compressed or not compressed.

Figure 3E:
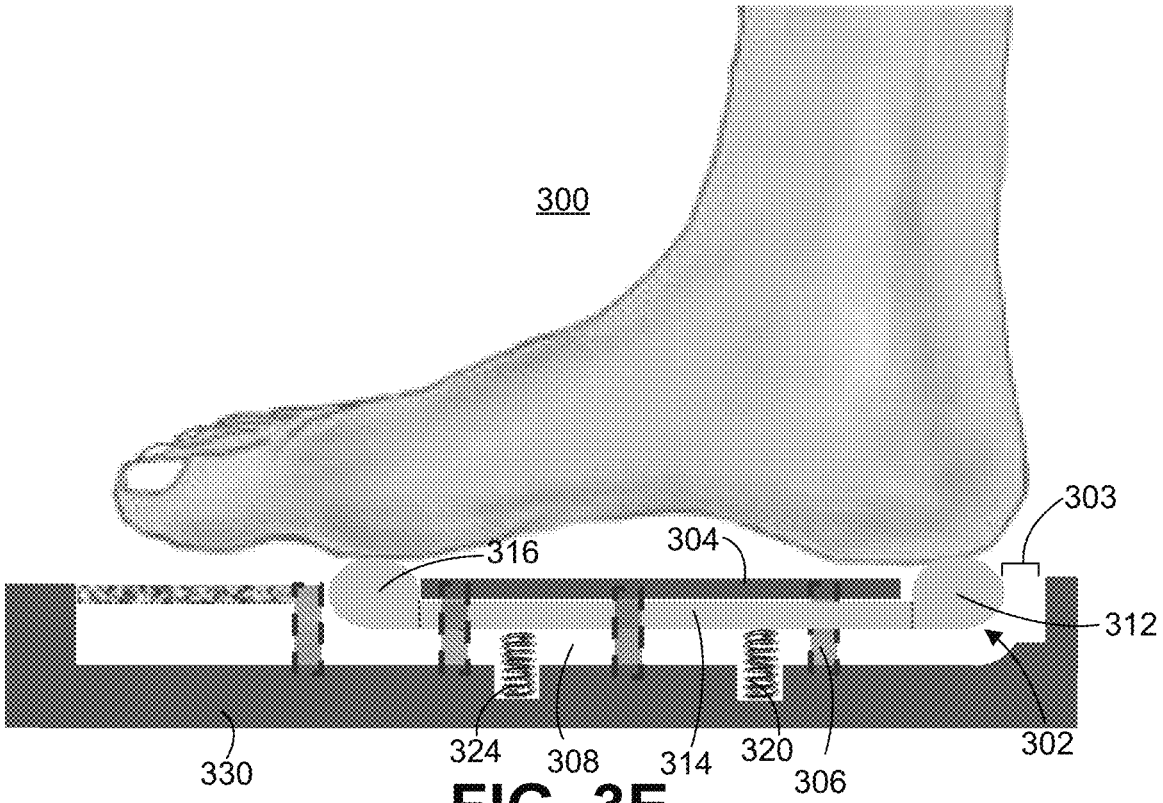
FIG. 3E is a side view illustrating another example of a mechanical ventilation system for footwear in a fourth position, in accordance with an embodiment of the present disclosure.

The fourth position of the walking movement, shown by FIG. 3E, illustrates the entire foot being lifted from the walking surface. When the entire foot is lifted, the front actuator portion 316 can be raised in an upward direction from the foot bed 330, which fully opens the air reservoir 308. The air that entered through the intake opening 303 then fills the air reservoir 308 under the movable part 302, completely refreshing the air supply in the mechanical ventilation system 300 so that the cycle can be restarted from the first position shown in FIG. 3B when a new step is taken. In such an example, the elastic elements 320 and 324 can be uncompressed.

Figure 4A:
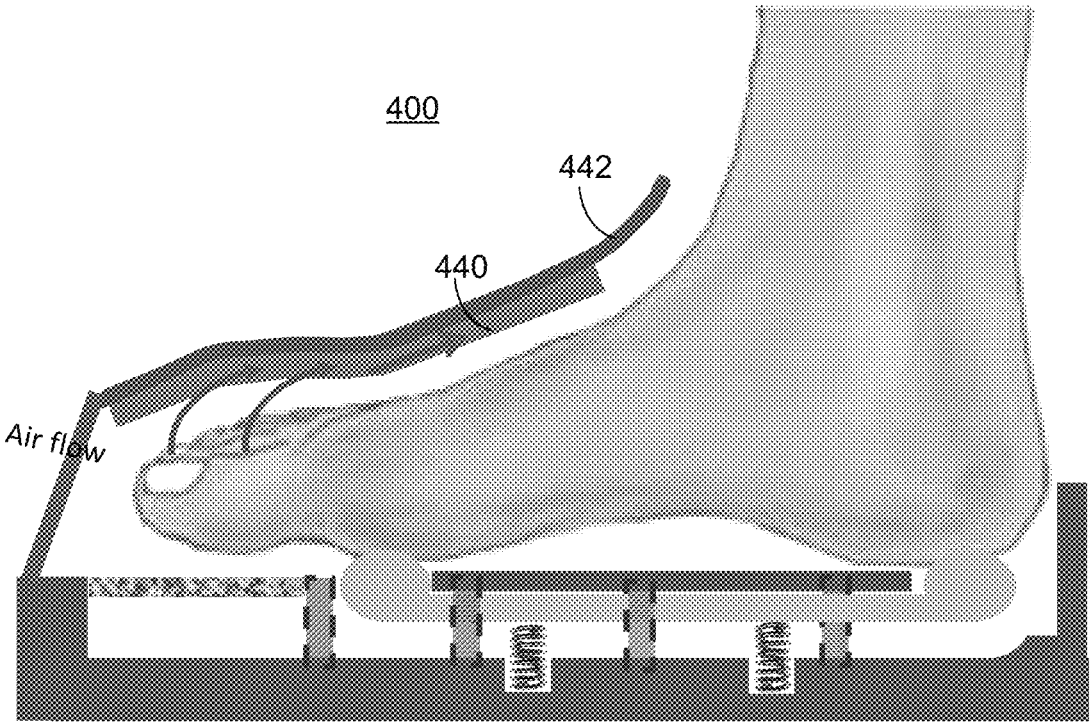
FIG. 4A is a side view illustrating an example of a mechanical ventilation system with an air flow escape path in a single direction air flow mechanism, in accordance with an embodiment of the present disclosure.

FIG. 4A is an example of a mechanical ventilation system 400 with an air flow escape path in a single direction, in accordance with an embodiment of the present disclosure. The mechanical ventilation system 400 can be similar to the mechanical ventilation system 300. The mechanical ventilation system 400 can further include a front lining 440 and a front outer shell 442 that create a front air vent.

The front lining 440 can include holes or channels (not shown) that allow air to flow out of the footwear. The front lining 440 can be semi-rigid or rigid. For example, the front lining 440 can flex, but may not be substantially compressible, to allow the air permeable holes or channels to remain open when the footwear's laces are tied or when the person is walking. Meanwhile, a front outer shell 442 covers the front lining 440 to provide a water proof outer cover for the footwear. The front outer shell 442 can extend beyond the front lining 440 so that water cannot easily enter the front lining 440 and flow into the footwear through the holes or channels. The front outer shell 442 and the front lining 440 can be longer than that shown in FIG. 4, such as for particular footwear, including work boots, water boots, fashion winter boots, or the like.

Figure 4B:
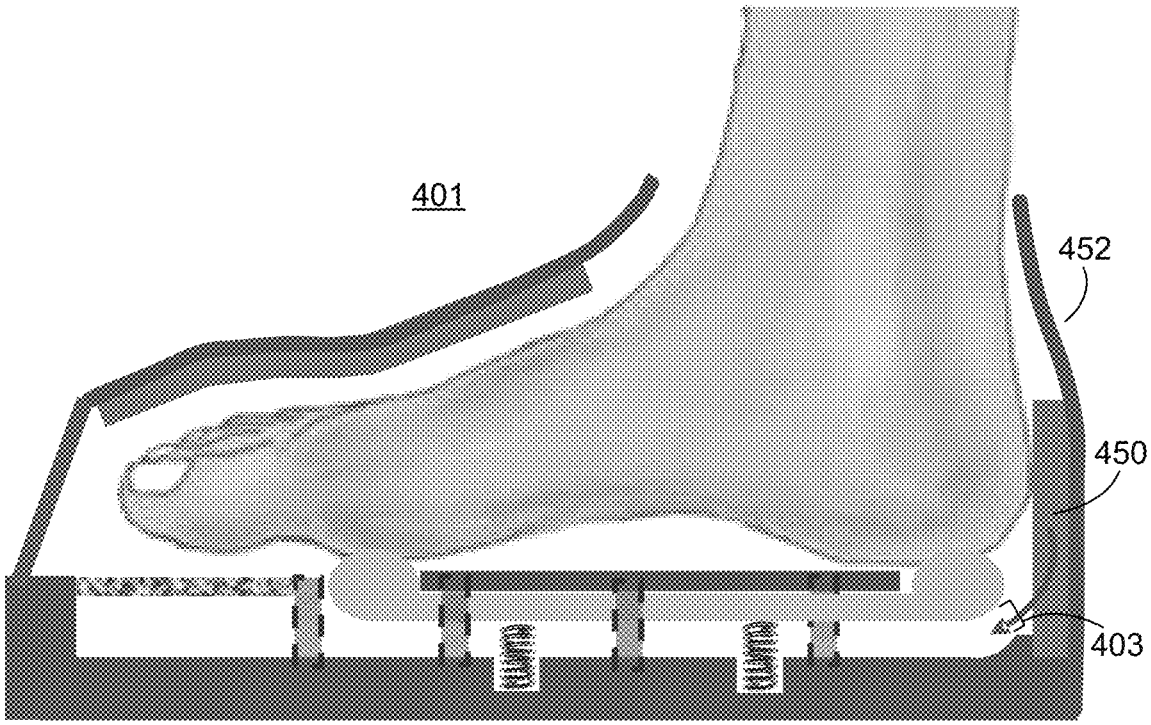
FIG. 4B is a side view illustrating an example of a mechanical ventilation system with an air flow input path in a single direction air flow mechanism, in accordance with an embodiment of the present disclosure.

FIG. 4B is an example of a mechanical ventilation system 401 with an air flow input path in a single direction, in accordance with an embodiment of the present disclosure. The mechanical ventilation system 401 can be similar to the mechanical ventilation system 400. The mechanical ventilation system 401 can further include a back lining 450 and a back outer shell 452 that create a back air vent. In some examples, the mechanical ventilation system 401 does not include the front lining 440 and/or the front outer shell 442.

The back lining 450 can include holes or channels that allow air to flow into the footwear. The back lining 450 can be semi-rigid or rigid, similar to the front lining 440. For example, the back lining 450 can flex, but may not be substantially compressible to allow the air permeable holes or channels to remain open when the user is walking. Meanwhile, the back outer shell 452 can cover the back lining 450 to provide a waterproof outer cover for the footwear. The back outer shell 452 can extend beyond the back lining 450 so that water cannot easily enter the back lining 450. The back outer shell 452 and the back lining 450 can be longer than that shown in FIG. 4B. Furthermore, the back lining 450 can be a multitude of shapes, such as a half-moon shape or a ring shape to surround the ankle and the base of the foot. Depending on the shape, an intake opening 403 can be bigger or smaller. For example, if the back lining 450 is curved away from the intake opening 403, the intake opening 403 can be larger.

Figure 5A:
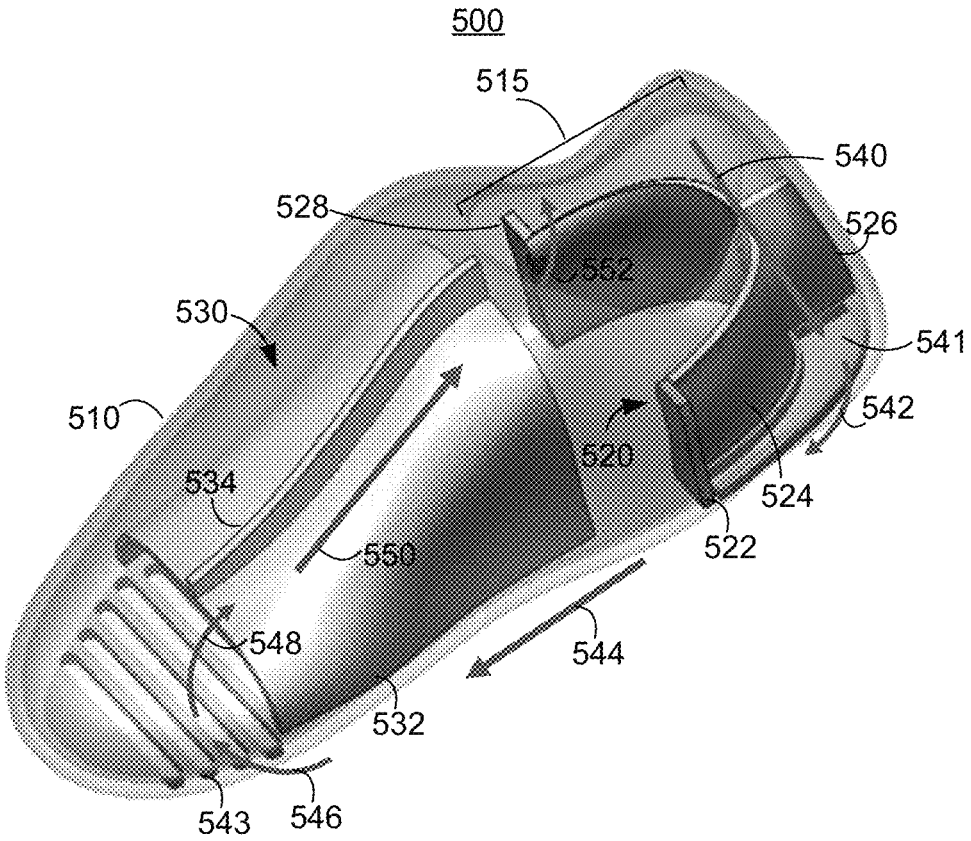
FIG. 5A is a top view of an example of an air vent apparatus for a mechanical ventilation system with an air flow escape path in a single direction, in accordance with an embodiment of the present disclosure.

FIG. 5A is a top view of an example of air vent apparatus 500 for a mechanical ventilation system with an air flow escape path in a single direction, in accordance with an embodiment of the present disclosure. The mechanical ventilation system can be included below an outer shoe layer 510, with a sole below the mechanical ventilation system. The outer shoe layer 510 can include a foot opening 515 that receives a foot of a user. A back inner shoe layer 520 and a front inner shoe layer 530 can be included inside of the outer shoe layer 510. While the outer shoe layer 510 is illustrated as semitransparent to better show the internal components, the outer shoe layer 510 can be solid and not show the components inside.

The back inner shoe layer 520 can create one or more pathways for air to flow from outside of the outer shoe layer 510 to inside of the outer shoe layer 510 as shown by arrow 540. In some examples, the air can flow between the back inner shoe layer 520 and the outer shoe layer 510 through the foot opening 515. The one or more pathways can be created by having a distance between the back inner shoe layer 520 and the outer shoe layer 510. In one illustrative example, the distance can be one centimeter. However, a person of ordinary skill in the art will recognize that the distance can be less or more than one centimeter. In some embodiments, the distance can vary along a length of the back inner shoe layer 520. For example, the distance can be larger near a back of the footwear and smaller near a front of the back inner shoe layer 520, as illustrated in FIG. 5A.

In some embodiments, the one or more pathways can be created by a shape of the back inner shoe layer 520. For example, the back inner shoe layer 520 can include a curved portion 524 and one or more support walls (e.g., support walls 522, 526, 528). The one or more support walls can ensure that paths for air flow are not collapsed during normal usage (e.g., a user walking). In some embodiments, the curved portion 524 can be a curvature similar to the outer shoe layer 510. The curvature can allow for a heel of a foot to be placed inside of the curved portion 524.

The curved portion 524 can be coupled to a first support wall 522 at a first end of the curved portion 524. The first support wall 522 can also be coupled to the outer shoe layer 510. In some embodiments, the first support wall 522 can create separation between the first curved portion 524 and the outer shoe layer 510 to provide a first pathway for air. In some embodiments, the first support wall 522 can close off the first pathway from the rest of the inside of the outer shoe layer 510 such that air that flows through the first pathway can be directed below the outer shoe layer 510. The curved portion 524 can also be coupled to a third support wall 528 at an opposite end of the curved portion 528, opposite of where the curved portion 524 is coupled to the first support wall 522. One of ordinary skill in the art will appreciate that the third support wall 528 may not be exactly opposite of the first support wall 522, and may be approximately opposite. A second pathway for air can be created between the second curved portion 528 and the outer shoe layer 510. The second pathway can be closed off from the rest of the footwear by the third support wall 528. The curved portion 524 can also be coupled to a second support wall 526 at a second location of the curved portion 545 (e.g., between the first end and the second end of the curved portion 524, such as half way between or other percentage). The second support wall 526 can also be coupled to the outer shoe layer 510. The second support wall 526 can perform similar functions to the first support wall 522. The second support wall 526 can separate the first pathway from the second pathway. In some embodiments, the back inner shoe layer 520 may not include the second support wall 526 such that the first pathway and the second pathway are combined into a single pathway between first support wall 522 to third support wall 528.

In other embodiments, the back inner shoe layer 520 can include straight portions that can be bent by a user's foot to form a curved portion. In such embodiments, the back inner shoe layer 520 would not include a curved portion unless force from a user's foot is applied to the back inner shoe layer 520. To facilitate bending, the back inner shoe layer 520 can be a flexible material (e.g., plastic, a polymer, or other suitable flexible material) that couples at a first location on the outer shoe layer 510 (near where the first support wall 522 couples to the outer shoe layer 510), extends straight from the first location to a second location on the outer shoe layer 510, couples to the second location (near where the second support wall 526 couples to the outer shoe layer 510), extends straight from the second location to a third location on the outer shoe layer 510, and couples to the third location (near where the third support wall 529 couples to the outer shoe layer 510).

In some embodiments, the outer shoe layer 510 can include one or more back holes 541 near the back of the outer shoe layer 510. The one or more back holes 541 can line up with the one or more pathways to allow for air from outside of the shoe to flow below the outer shoe layer 510 to a location where a movable part (e.g., such as movable part 302 or other movable part described herein) can be located. The air can flow through one or more back holes 541 as illustrated by arrow 542. The air can continue to flow under the outer shoe layer 510, as illustrated by arrow 544, until the air reaches a front end of the outer shoe layer 510. The area under the outer shoe layer 510, corresponding to where arrow 544 is located, may include a mechanical ventilation system as described herein. The metical ventilation system may receive air from a direction corresponding to arrow 542 and expel air from a direction corresponding to arrow 546.

The front end of the outer shoe layer 510 can include one or more front holes 543 to allow for air to flow from under the outer shoe layer 510 (where a movable pump can be located) back into the outer shoe layer 510. In some examples, a foot of a user can be located over the one or more front holes 543.

The air can then flow, as illustrated by arrow 548, above the front inner shoe layer 530. In some embodiments, the front inner shoe layer 530 can include a curved portion 532 and a support wall 534. The support wall 534 can be coupled to the outer shoe layer 510. The support wall 535 can create separation between the front inner shoe layer 530 and the outer shoe layer 510 to create one or more exit pathways for air. A first exit pathway can be to the left of the support wall 534, between the outer shoe layer 510 and the front inner shoe layer 530. A second exit pathway can be to the right of the support wall 534, between the outer shoe layer 510 and the front inner shoe layer 530. Air can flow through the one or more exit pathways, as illustrated by arrow 550, and out of the foot opening 515, as illustrated by arrow 552. In some embodiments, a middle portion of a user's foot can be located under the front inner shoe layer 530.

Figure 5B:
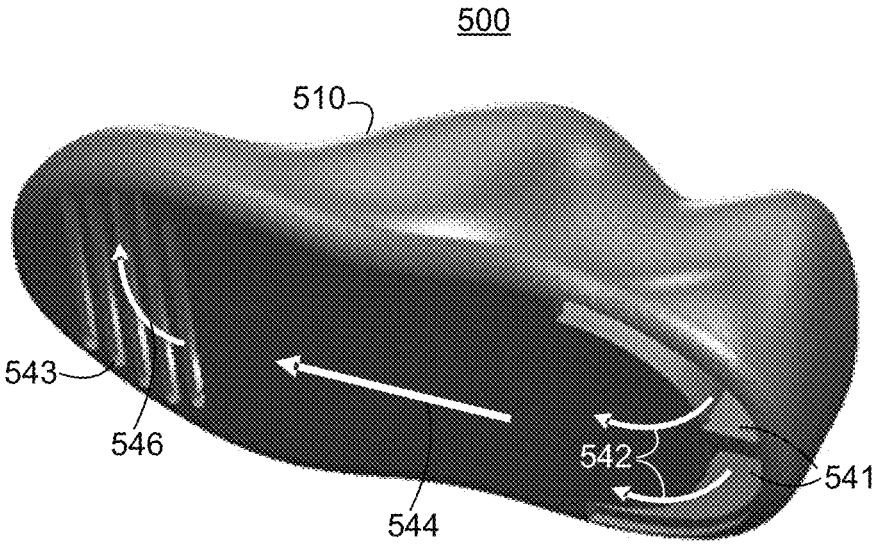
FIG. 5B is a bottom view of an air vent apparatus, in accordance with an embodiment of the present disclosure.

FIG. 5B is a bottom view of the air vent apparatus 500, in accordance with an embodiment of the present disclosure. FIG. 5B illustrates the outer shoe layer 510 as a nontransparent piece, as opposed to semitransparent as in FIG. 5A. The outer shoe layer 510 includes the one or more back holes 541 located at the back of the outer shoe layer 510. As described above, the one or more back holes 541 allow air to exit the outer shoe layer 510. In some embodiments, the air can flow as illustrated by arrows 542, 544, 546, such that the air flows into a mechanical ventilation system (as described herein) by way of arrow 542, flows through the mechanical ventilation system roughly corresponding to arrow 544, flows out of the mechanical ventilation system and into a front portion of a footwear in a direction corresponding to arrow 546, and exits the front portion through one or more exit pathways (as illustrated by arrow 550 in FIG. 5A). At the arrow 546, the air can flow into the one or more front holes 543 to refresh an area where a front of portion of a foot of a user would be located.

Figure 5C:
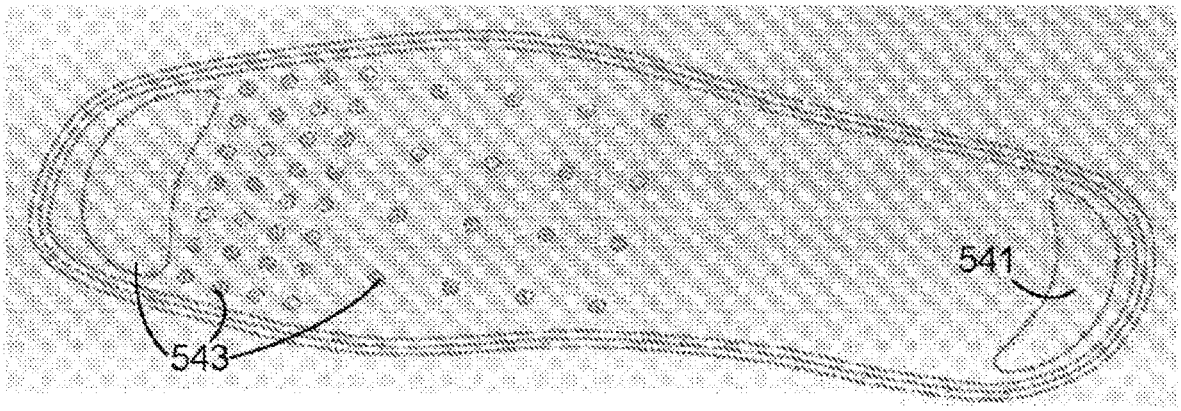
FIG. 5C depicts an air intake opening and exhaust openings for an air vent layer, in accordance with an embodiment of the present disclosure.

FIG. 5C depicts an air intake opening 541 and exhaust openings 543 for an air vent layer, in accordance with an embodiment of the present disclosure. The air vent layer may be on top of an air reservoir, allowing air to pass through opening on the air vent layer to enter and exit the air reservoir. For example, the air intake opening 541 (which may correspond to the one or more back holes 541 depicted in FIG. 5B) may be located near a back of a piece of footwear. The air intake opening may line up with one or more pathways (e.g., as illustrated by arrow 540 in FIG. 5A) to allow for air from outside of the piece of footwear to flow into an air reservoir that is used by a mechanical ventilation system. While FIG. 5C illustrates a single air intake opening, it should be recognized that there may be multiple air intake openings of similar or varying size and/or shape.

The air can continue to flow in the air reservoir until the air reaches the exhaust openings 543. The air can flow out of one or more of the exhaust openings 543 to refresh an area of the piece of footwear that holds a foot. The exhaust openings 543 are illustrated as varying in intensity in a direction towards a front of the piece of footwear. For example, the exhaust openings furthest from the front are spread wider apart than the exhaust openings closer to the front. In addition, a single exhaust opening that is bigger than other exhaust openings is located closest to the front such that more air is allowed to escape through the single exhaust opening. While FIG. 5C illustrates exhaust openings of particular size, shape, and configuration, it should be recognized that there may be different sizes, shapes, and configurations used.

Figure 5D:
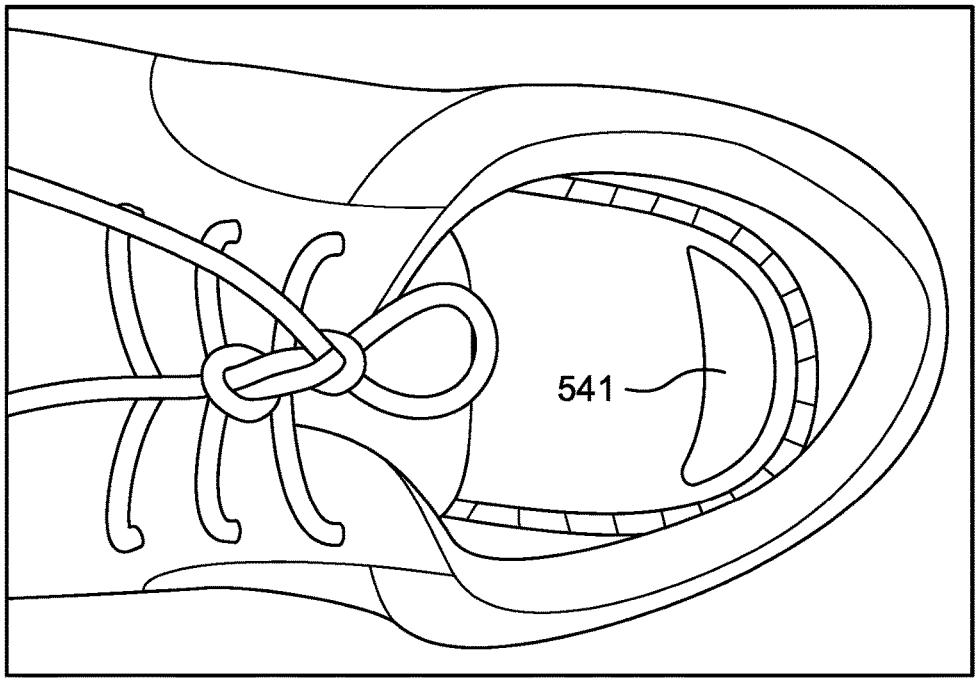
FIG. 5D depicts an air intake opening in a piece of footwear, in accordance with an embodiment of the present disclosure.

FIG. 5D depicts an air intake opening 541 in a piece of footwear, in accordance with an embodiment of the present disclosure. In FIG. 5D, the air intake opening 541 is located at the back of the piece of footwear, near where a heel of a user would be located. The air intake opening 541 illustrated in FIG. 5D may receive air from outside of the piece of footwear to direct to a front portion of the piece of footwear to refresh air located therein.

Figure 5E:
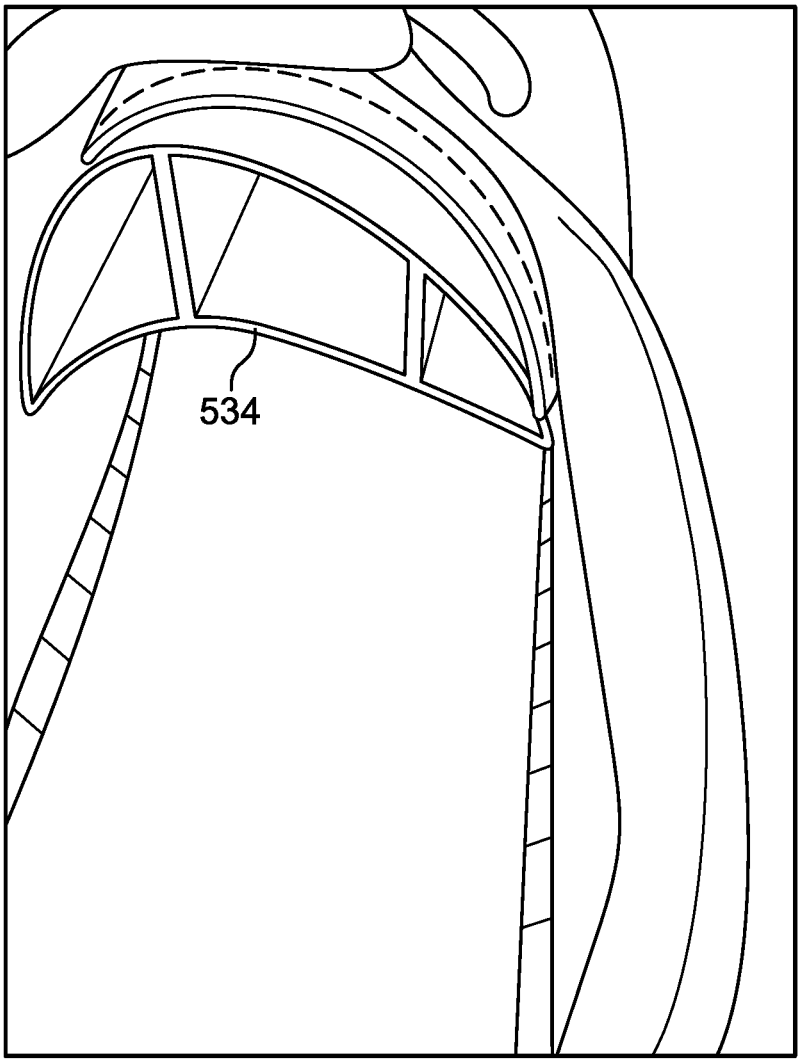
FIG. 5E depicts an exhaust tunnel in a piece of footwear, in accordance with an embodiment of the present disclosure.

FIG. 5E depicts an exhaust tunnel 535 in a piece of footwear, in accordance with an embodiment of the present disclosure. The exhaust tunnel 535 may correspond to the areas on the sides of the support wall 534 illustrated in FIG. 5A. The exhaust tunnel 535 may be a pathway for air to go from a front portion of the piece of footwear to outside of the piece of footwear. The pathway may be separated into multiple pathways, as illustrated in FIG. 5E. The multiple pathways may allow the exhaust tunnel 535 to include structural columns to maintain the shape of the exhaust tunnel 535, even when shoe laces are tied. The exhaust tunnel 535 may be inserted between a foot of a user and a top of the piece of footwear when the foot is inside of the piece of footwear. In other words, the exhaust tunnel 535 may be coupled to an inside of the top of the piece of footwear, as illustrated in FIG. 5E. It should be recognized that the exhaust tunnel 535 may be made out of any suitable material, including plastic, metal, fabric, or the like.

Figure 5F:
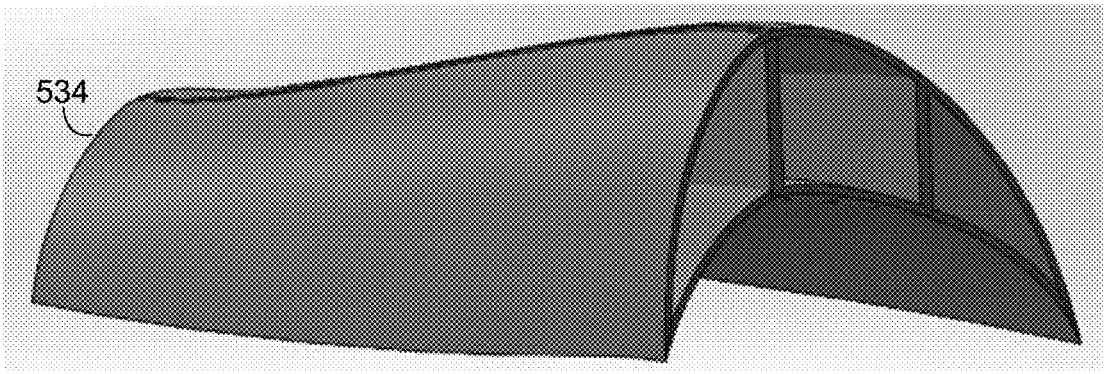
FIG. 5F is a perspective view of an exhaust tunnel, in accordance with an embodiment of the present disclosure.

FIG. 5F is a perspective view of an exhaust tunnel 534, in accordance with an embodiment of the present disclosure. The exhaust tunnel 534, depicted in FIG. 5F, is longer than it is wide. The length of the exhaust tunnel 534 may allow a pathway to be created from near a front of a piece of footwear to an area where air may flow out of the piece of footwear (e.g., the area may be near a tongue of the piece of footwear). The width of the exhaust tunnel 534 may correspond to a width of the piece of footwear. For example, the exhaust tunnel 534 may be similar width as the piece of footwear. For another example, the exhaust tunnel 534 may be shorter than the width of the piece of footwear.

Figure 5G:
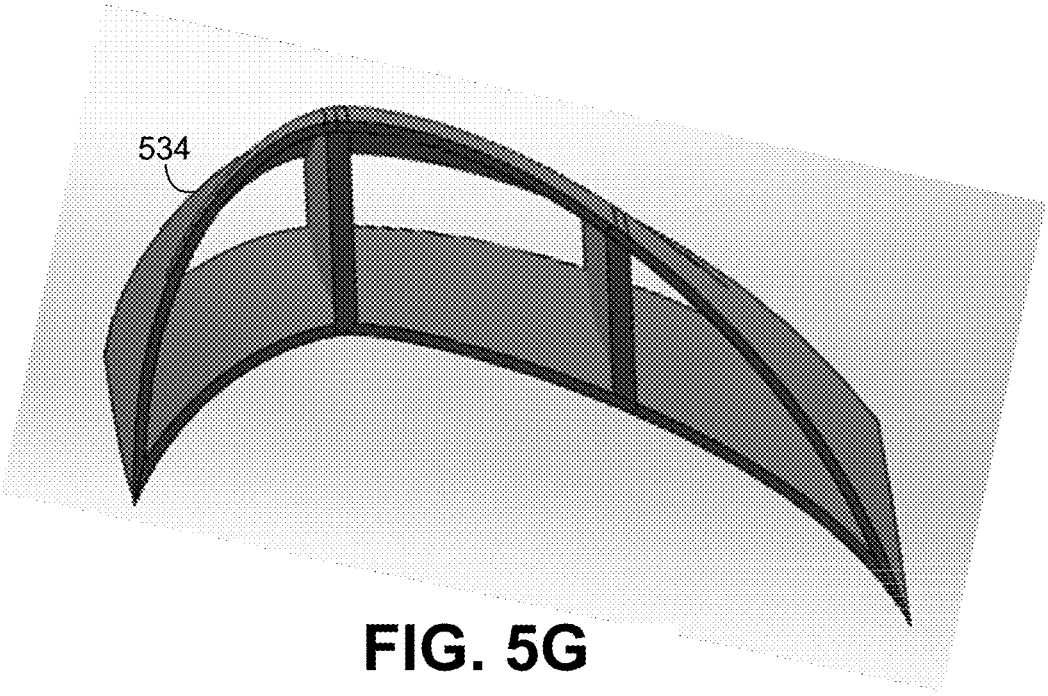
FIG. 5G is a front view of an exhaust tunnel, in accordance with an embodiment of the present disclosure.

FIG. 5G is a front view of an exhaust tunnel 534, in accordance with an embodiment of the present disclosure. The exhaust tunnel 534, depicted in FIG. 5G, has different sized pathways that make up the exhaust tunnel 534. The size of each pathway may correspond to a foot that would be under the exhaust tunnel 534 when the foot is in a piece of footwear that includes the exhaust tunnel 534. For example, the exhaust tunnel 534 illustrates that a leftmost pathway is taller than other pathways, a middle pathway is substantially square, and a rightmost pathway is wider than other pathways. In some examples, the size of the different pathways may depend on a shape of the piece of footwear.

Figure 6:
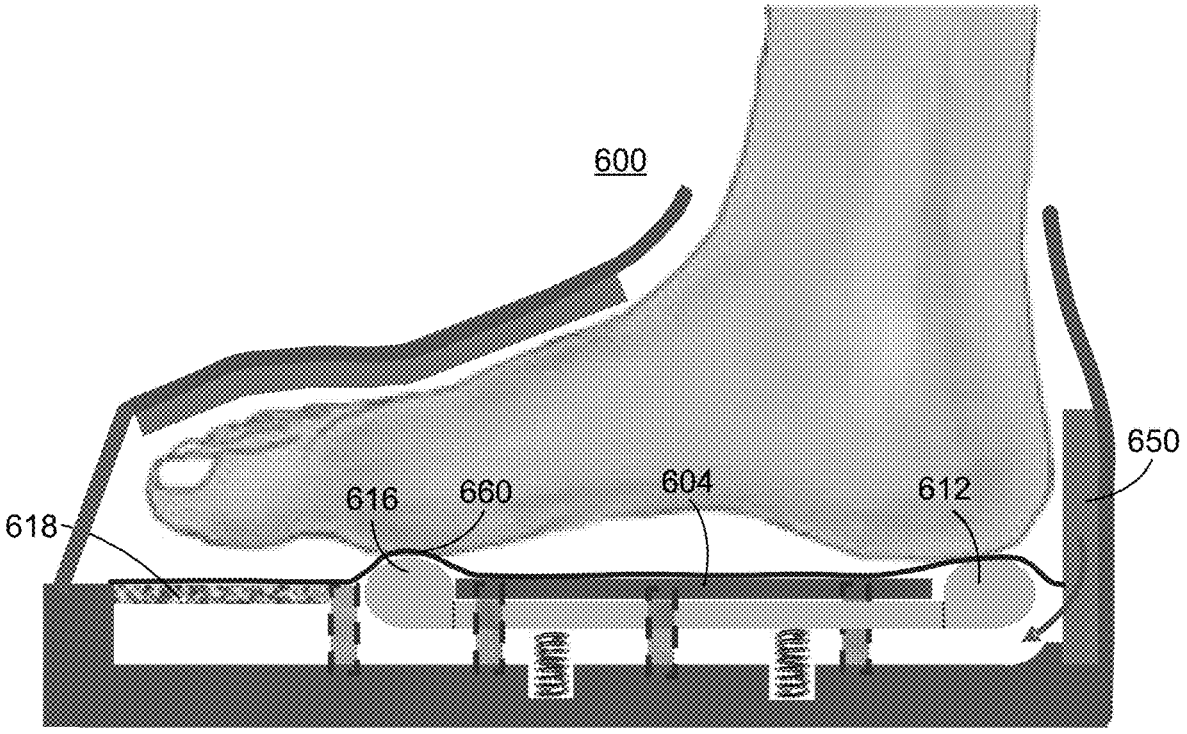
FIG. 6 is a side view illustrating an example of a mechanical ventilation system with a sealed foot platform in a single direction air flow mechanism, in accordance with an embodiment of the present disclosure.

FIG. 6 is a side view illustrating an example of a mechanical ventilation system 600, in accordance with an embodiment of the present disclosure. The mechanical ventilation system 600 can be similar and include any of the components of the mechanical ventilation system 300, 400, and/or 500.

The mechanical ventilation system 600 can further include a sealed foot platform 660. The sealed foot platform 660 can cover a surface discontinuity, caused by the mechanical ventilation system 600, where the foot rests. For example, a surface discontinuity can exist at an exhaust opening 618 a front actuator portion 616, the substantially rigid surface 604, the rear actuator portion 612, the back lining 650, or any other area of the mechanical ventilation system 600 that can cause discomfort for a foot. The sealed foot platform 660 can be implemented with a number of materials, including fabric, flexible plastic material, or other suitable cushioning surface.

FIG. 7 is another example of a mechanical ventilation system 700, in accordance with an embodiment of the present disclosure. The mechanical ventilation system 700 can include a movable part 702. The movable part 702 can include a front actuator portion 716 and a rear actuator portion 712 at different locations as compared to the actuators shown in FIGS. 3A-3E. In the example shown in FIG. 7, the front actuator portion 716 is closer to the foot center; however, the front actuator portion 716 can continue to perform the same function as that performed by the front actuator portion 316 described above with respect to FIG. 3A-FIG. 3E. By moving the front actuator portion 716 closer to the middle or arch of a foot, the foot itself can come to rest in a more natural position when the user is standing. For example, the front actuator portion 716 can be positioned under the arch of the foot. The front actuator portion 716 can be positioned so that the front actuator portion 716 can still be lowered by a foot when a step is taken. The locations of actuators 712 and 716 can be modified to be closer to the center of the foot than that shown in FIG. 7. The locations of the actuators 712 and 716 can depend on the footwear design and application, including the shape of the foot, the use for the footwear, or any other factor.

As also can be seen in FIG. 7, an intake opening 703 can be provided near a rear actuator portion 712 to allow air to enter an air reservoir 708. The intake opening 703 can include an air-permeable surface, similar to that described above, to allow air to enter the mechanical ventilation system 700 while providing stability for a foot. The mechanical ventilation system 700 can also include an exhaust opening 718 that is provided at the opposite end of the footwear to allow air to exit the footwear. The exhaust opening 718 can have the same properties and functionality as the exhaust opening 318 of FIG. 3A-FIG. 3E, in that it allows air to escape the mechanical ventilation system 700 while also providing stability for the foot.

Figure 8A:
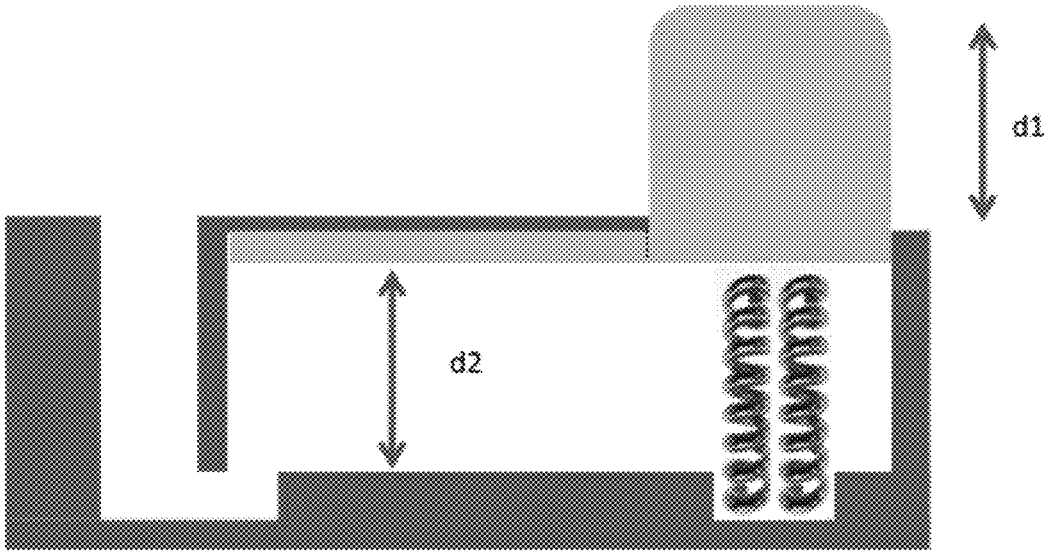
FIG. 8A-FIG. 8B illustrate an example of a compression (or depression) depth of a movable part, before and after compression/depression, in a single direction mechanical ventilation system, in accordance with an embodiment of the present invention.
Figure 8B:
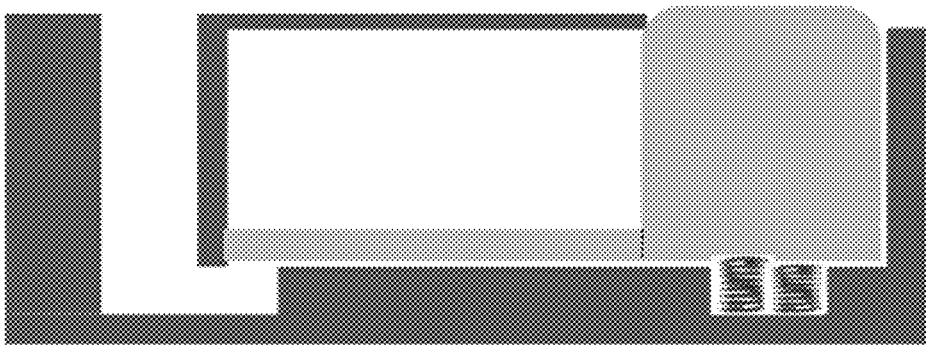

FIG. 8A and FIG. 8B illustrate an example of a lowering depth of a movable part, before and after lowering, in a single direction mechanical ventilation system, in accordance with an embodiment of the present invention. The example illustrates that a lowering depth (d1) can be approximately equal to an air reservoir depth (d2). The lowering depth can include a height of an actuator that is above a substantially rigid surface. The air reservoir depth can include a distance that a movable part can lower. As can be seen in FIG. 8A and FIG. 8B, d1 can be approximately equal to d2. In such an example, in order to increase the volume of air movement, which is a function of d2, the height of the actuator that is above the substantially rigid surface can be increased. However, by increasing the height of the actuator that is above the substantially rigid surface, the footwear can become exceedingly tall, unstable, and/or uncomfortable.

Figure 9A:
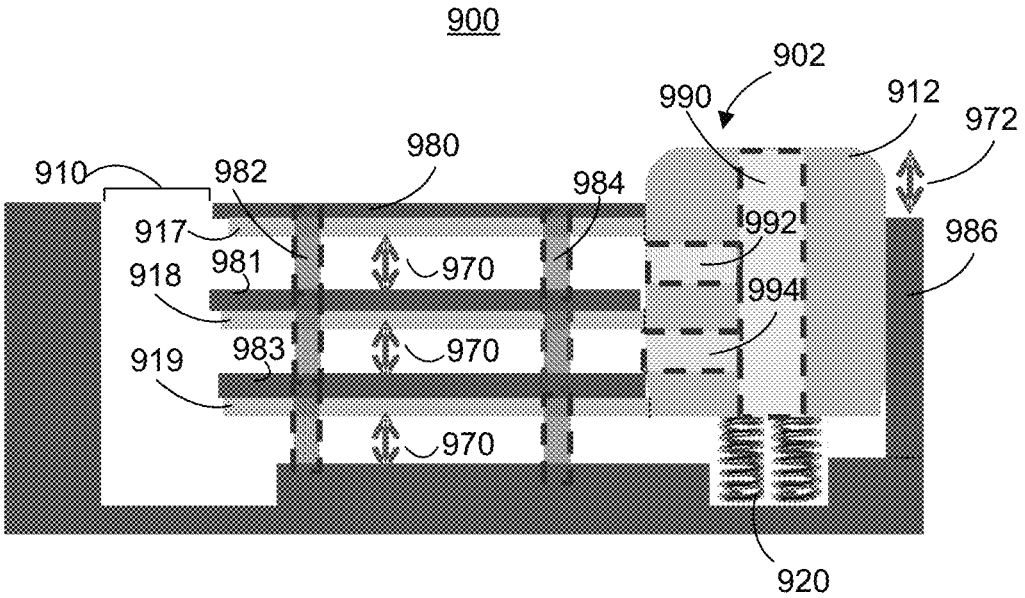
FIG. 9A-FIG. 9B are side views illustrating another example of a mechanical ventilation system, before and after compression/depression of a movable part, in accordance with an embodiment of the present disclosure.

FIG. 9A illustrates an example of a mechanical ventilation system 900 that enhances air flow by taking advantage of parallel air reservoirs, in accordance with an embodiment of the present disclosure. The mechanical ventilation system 900 is shown in a resting position in FIG. 9A. In the resting position, an elastic element 920 of the mechanical ventilation system 900 can be decompressed. The mechanical ventilation system 900 can provide increased air flow with less lowering depth by utilizing a multi-level design.

The movable part 902 can include an actuator 912, a top level extension 917, a middle level extension 918, and a bottom level extension 919. However, one of skill in the art will appreciate that the movable part 902 can include more or less extensions that are stacked vertically. By adding multiple levels of extensions, organized vertically, the mechanical ventilation system 900 can decrease a lowering depth 972 (d1) of the actuator 912 without linearly losing the amount of air displaced. As shown in FIG. 9A, a lowering depth 972 (d1) of the actuator 912 is equal to each reservoir depth 970, which are under the top level extension 917, the middle level extension 918, and the bottom level extension 919. The reservoir depth of the top level extension 917, the middle level extension 918, and the bottom level extension 919 can be equal to each other, or can be slightly different. By adding three levels of extensions, lowering the movable part 902 by the lowering depth 972 can result in approximately three times the amount of air displaced. In one example, as the actuator 912 is lowered by 1 centimeter, the movable part 902 can compress up to 3 centimeters of air. It can be beneficial to minimize the lowering depth 972 of the actuator 912 to make the footwear more stable and comfortable for the user. The number of extensions that can be included in the footwear can be limited based on the height of the shoe. Each new extension requires an additional amount of height to be added to the mechanical ventilation system 900.

Each of the extensions (i.e., the top level extension 917, the middle level extension 918, and the bottom level extension 919) can be adjacent to a substantially rigid surface (e.g., substantially rigid surfaces 980, 981, 983). To support each of the substantially rigid surfaces, one or more columns (e.g., a first column 982 and a second column 984) can be added to the mechanical ventilation system 900 and can attach to each of the substantially rigid surfaces. In some embodiments, a column can be hollow to allow air flow. While FIG. 9A illustrates two columns, one of skill in the art will appreciate that there may be more or less columns, the columns may be offset more or less than that shown, or there may be no columns. In examples in which there are no columns, the substantially rigid surfaces can be attached to another part of the mechanical ventilation system 900, such as a vertical column 986 (located to the right of the movable part 902) or a side wall of the footwear. Attaching the substantially rigid surfaces to the side wall can eliminate the need for columns, and thus reduce the number of elements taking up space in the air reservoirs. In some embodiments, only a single substantially rigid surface (e.g., the substantially rigid surface 980) may be included in the mechanical ventilation system 900. In such embodiments, substantially rigid surfaces 981, 983 may not be included.

In some embodiments, the actuator 912 can include a vertical hollow region 990, a first horizontal hollow region 992, and a second horizontal hollow region 994. The hollow regions 990, 992, and 994 can allow fresh air to flow from an area above the actuator 912 to one or more of the air reservoirs located below each of the top level extension 917, the middle level extension 918, and the bottom level extension 919. However, one of skill in the art will appreciate that the form of the hollow regions 990, 992, 994 can be different than that illustrated in FIG. 9A. For example, the hollow regions 990, 992, 994 can be a straight path from the top of the actuator 912 to the air reservoirs located below each of the top level extension 917, the middle level extension 918, and the bottom level extension 919. In some examples, the hollow regions 990, 992, 994 can be narrower or wider than that shown. In some examples, the hollow regions 990, 992, 994 do not lead to the top of the actuator 912. For example, the hollow regions 990, 992, 994 can lead horizontally through the actuator 912, providing air flow from the area including the vertical column 986. In such an example, instead of having a vertical hollow region 990, the first horizontal hollow region 992 and the second horizontal hollow region 994 would extend all the way to the vertical column 986. In such an example, the vertical column 986 can allow air to flow through it, or there can be some distance between the vertical column 986 and the actuator 912 to allow air to flow into the hollow regions 992 and 994. The precise positioning of the hollow regions 990, 992, 994 can be anywhere in the mechanical ventilation system 900 that facilitates the addition of fresh air into the air reservoirs below the top level extension 917, the middle level extension 918, and/or the bottom level extension 919.

Figure 9B:
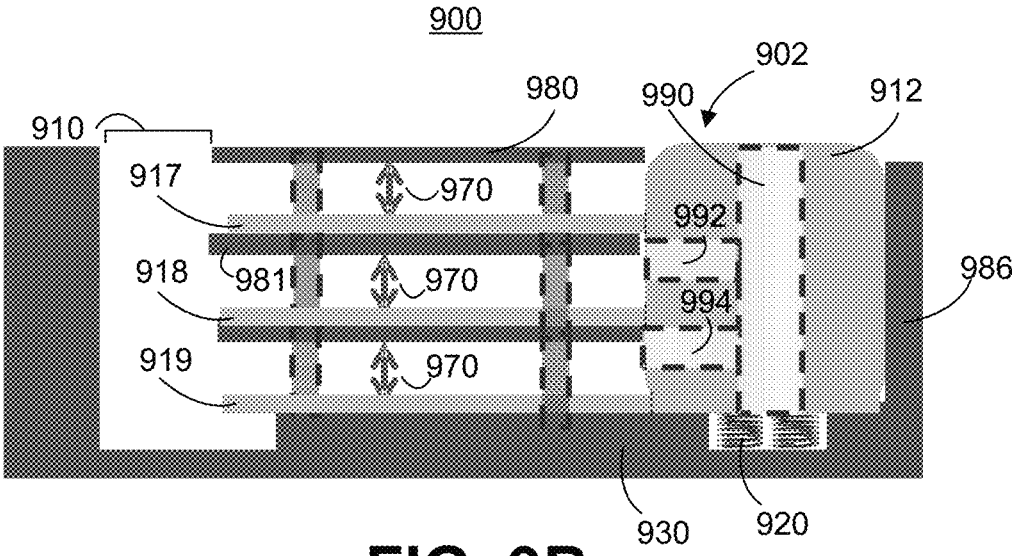

FIG. 9B illustrates an example of the mechanical ventilation system 900 after the movable part 902 is lowered down. In such an example, the elastic element 920 can be compressed. The movable part 902 can be lowered down when the user steps on the actuator 912 (e.g., when the user takes a step). When the movable part 902 is lowered, the vertical hollow region 990 can be closed off by a foot bed 930, facilitating a one-way air flow through the system into the air reservoirs under each of the top level extension 917, the middle level extension 918, and/or the bottom level extension 919. Each of the extensions can lower the full distance of the reservoir depth 970. The lowering can force fresh air out of an exhaust opening 910 and provide ventilation to wherever the exhaust opening 910 leads, such as a front portion of a foot. In some examples, the exhaust opening 910 can include an air-penetrable surface, as described above.

Figure 10:
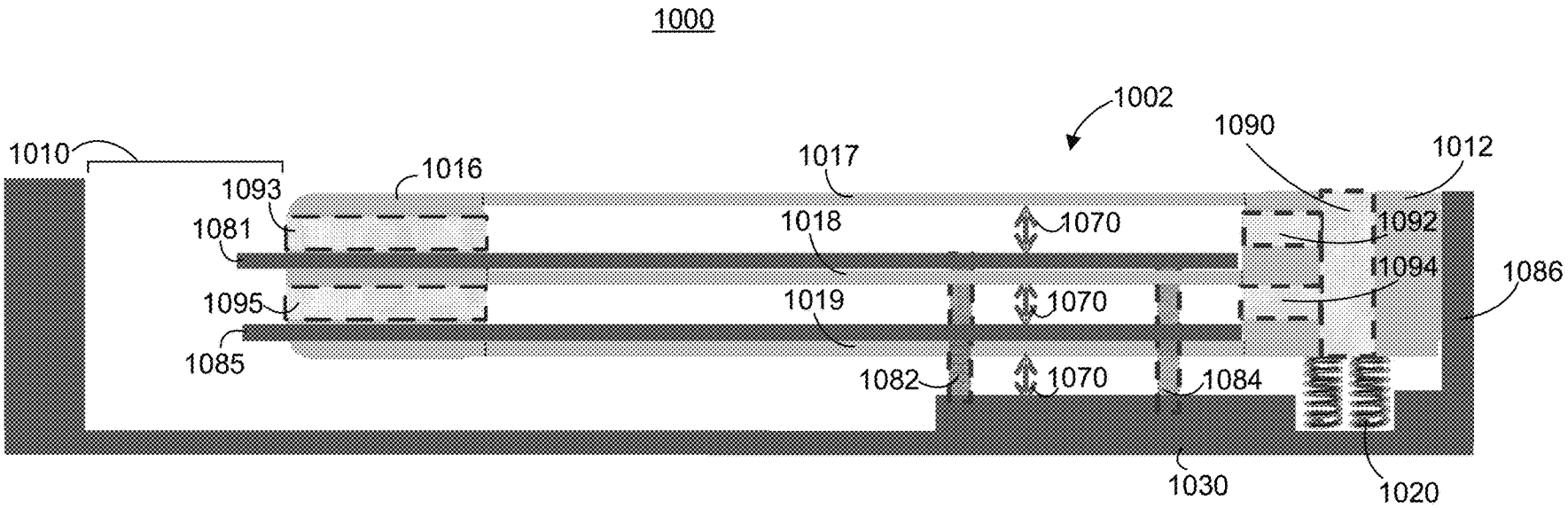
FIG. 10 illustrates another example of a mechanical ventilation system that enhances air flow by taking advantage of parallel air reservoirs, in accordance with an embodiment of the present disclosure.

FIG. 10 illustrates an example of a mechanical ventilation system 1000, which enhances air flow by taking advantage of parallel air reservoirs, in accordance with an embodiment of the present disclosure. The mechanical ventilation system 1000 can include a movable part 1002. The movable part 1002 can create parallel air reservoirs that allow a depression depth 1070 of the movable part 1002 to displace air corresponding to approximately three times the depression depth 1070. The increase in air displacement can be because each air reservoir can displace a volume of air corresponding to the depression depth 1070.

To facilitate the parallel air reservoirs, the movable part 1002 can include one or more actuators (e.g., a front actuator portion 1016 and a rear actuator portion 1012). The rear actuator portion 1012 can include a vertical hollow region 1090, a first horizontal region 1092, and a second horizontal region 1094. The hollow regions 1090, 1092, and 1094 can operate as described above in FIGS. 9A and 9B. For example, the hollow regions 1090, 1092, and 1094 can provide air to air reservoirs.

In some embodiments, the front actuator portion 1016 and the rear actuator portion 1012 can be connected to each other by one or more extensions (e.g., a bottom level extension 1019, a middle level extension 1018, and a top level extension 1017). In some embodiments, a top of the front actuator portion 1016 and/or a top of the rear actuator portion 1012 can be level with the top level extension 1017, as shown in FIG. 10. In such embodiments, a substantially rigid surface above the top level extension 1017 can be removed from the mechanical ventilation system 1000 such that a foot of a user can rest on the movable part 1002 rather than the substantially rigid surface. In other embodiments, the top of the front actuator portion and/or the top of the rear actuator portion can raise above the top level extension, as shown in FIG. 9A. In some embodiments, the mechanical ventilation system 1000 can include one or more substantially rigid surfaces (e.g., middle substantially rigid surface 1081 and lower substantially rigid surface 1085).

Above each substantially rigid surface 1081 and 1085 can be an air reservoir, as discussed above. The air reservoir can be between a substantially rigid surface and an extension, such as between substantially rigid surface 1081 and top level extension 1017. In some embodiments, the air reservoir can maintain maximum volume when the movable part 1002 is being pushed in an upward direction. In some embodiments, the movable part 1002 can be pushed in an upward direction by one or more elastic elements (e.g., elastic element 1020). In some embodiments, air is pushed out of the air reservoirs when the one or more extensions are pushed toward the substantially rigid surfaces.

In some embodiments, the front actuator portion 1016 can include a top horizontal region 1093 and a bottom horizontal region 1095. The top horizontal region 1093 can provide a path for air to exit from an air reservoir that is under the top level extension 1017 when the movable part 1002 is lowered by a foot of a user. The bottom horizontal region 1095 can provide a path for air to exit from an air reservoir under the middle level extension 1081 when the movable part 1002 is lowered by the foot of the user. The amount of air displaced by each extension, which exits through the horizontal regions 1093, 1095, can correspond to a depression depth 1070. The depression depth 1070 can be a distance that the movable part 1002 can move downward before at least one of the extensions 1017, 1018 makes contact with the substantially rigid surfaces 1081, 1085 respectively. The front actuator portion 1016 can facilitate a more thorough compression of the air reservoir when the movable part is compressed/depressed. In some examples, the second actuator can reduce an amount of tilt of the movable part 1002 when the actuators are compressed or depressed. The tilt can be present when a movable part only includes one actuator (e.g., a rear actuator portion). In such examples, the side opposite of the one actuator (which can extend along an air reservoir) might not have an element to push the side opposite of the one actuator down without a second actuator. Also, the first and second actuator can work together to perform peristaltic compression, where the air is pushed from the back to the front when the user is walking.

Figure 11A:
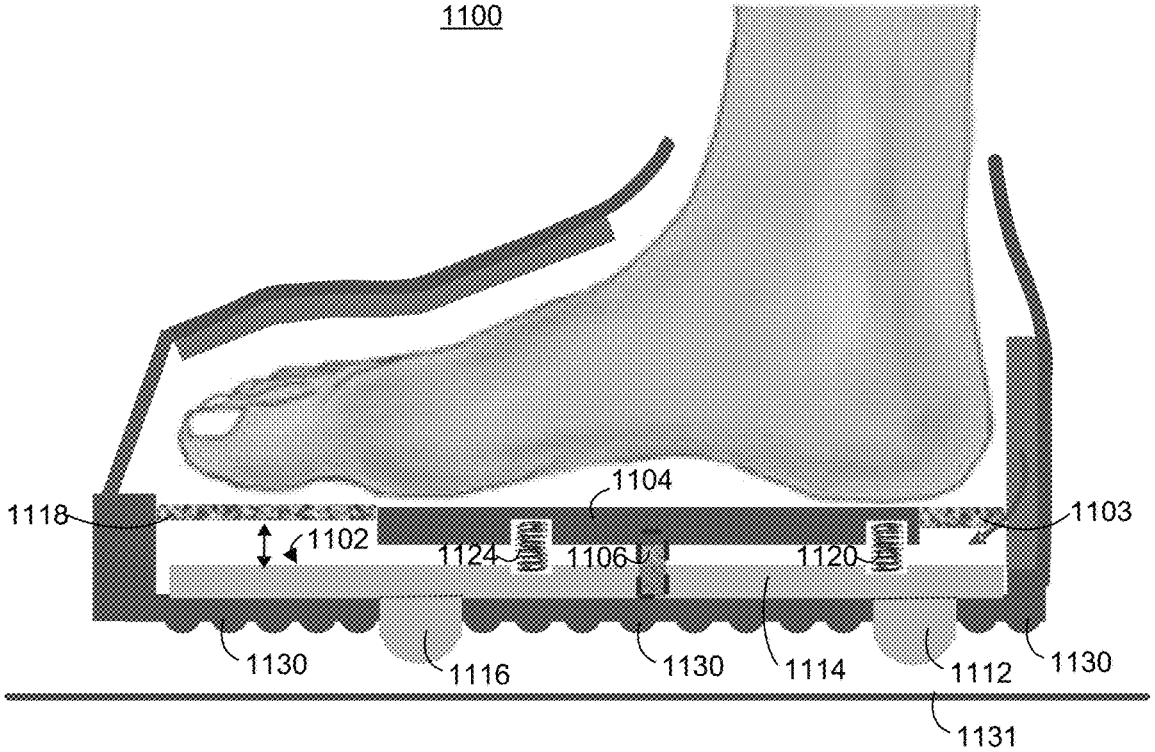
FIG. 11A is a side view illustrating another example of a mechanical ventilation system for footwear in a raised position, in accordance with an embodiment of the present disclosure.

FIG. 11A is a side view illustrating an example of a mechanical ventilation system 1100 for footwear in a raised position, in accordance with an embodiment of the present disclosure. Similar to mechanical ventilation systems discussed above, the mechanical ventilation system 1100 can include a movable part 1102. The movable part 1102 can include a front actuator portion 1116, a rear actuator portion 1112, and an extension 1114.

However, unlike the embodiments described above, the front actuator portion 1116 and the rear actuator portion 1112 can protrude from the movable part 1102 in a direction toward a ground 1131. By protruding down rather than up, the front actuator portion 1116 and the rear actuator portion 1112 can be moved when they are in contact with the ground 1131 rather than when the actuators are in contact with a foot. In some embodiments, a sole 1130 of the footwear can include one or more holes so that the actuators can make contact with the ground 1131. In some embodiments, the actuators can protrude farther down than the sole 1130. By protruding farther than the sole 1130, the actuators can be pushed in an upward direction by the ground 1131 until the actuators are on the same level or plane as the sole 1130.

The movable part 1102 can be continuously pushed toward the ground 1131 by one or more elastic elements (e.g., elastic elements 1120, 1124) with a force that allows the extension 1114 to be flush with a top portion of the sole 1130; however, the force should not be so much as for the user to feel the movable part 1102 when the foot of the user is on the ground 1131. Because gravity is also pushing the movable part 1102 toward the ground, the elastic elements 1120, 1124 can exert a force that includes gravity. In some embodiments, the extension 1114 can be pushed downward, by gravity and/or one or more elastic elements, such that the extension 1114 is in contact with the top portion of the sole 1130. The elastic elements 1120, 1124 can be coupled to a substantially rigid surface 1104. The substantially rigid surface 1104 can also provide support for a foot of a user to rest on. An area between the substantially rigid surface 1104 and the extension 1114 can be an air reservoir, which can hold air.

In some embodiments, an intake opening 1103 can be provided near a back side of the air reservoir to allow air to enter the air reservoir. The intake opening 1103 can include an air-permeable surface, similar to that described above, to allow air to enter the air reservoir while providing stability for a foot. The mechanical ventilation system 1100 can also include an exhaust opening 1118 that is provided at the opposite end of the air reservoir to allow air to exit the air reservoir. The exhaust opening 1118 can have the same properties and functionality as the exhaust opening 318 of FIG. 3A-FIG. 3E, in that it allows air to escape the mechanical ventilation system 1100 while also providing stability for the foot.

Figure 11B:
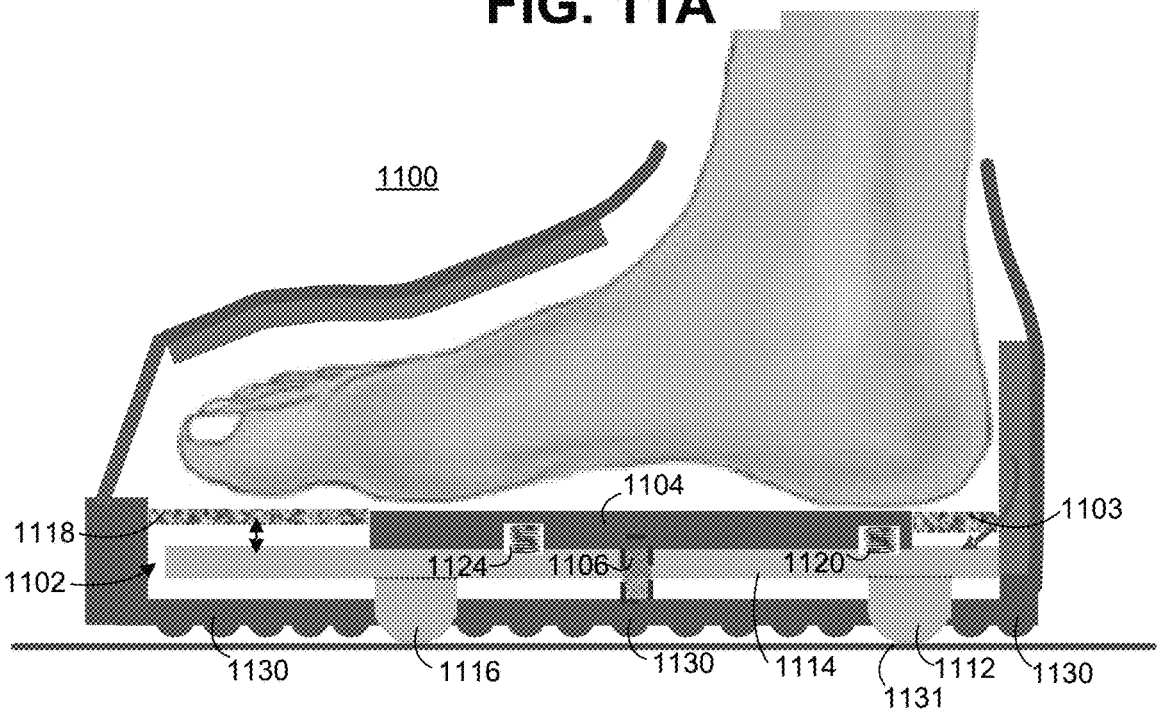
FIG. 11B is a side view illustrating another example of a mechanical ventilation system for footwear in a lowered position, in accordance with an embodiment of the present disclosure.

FIG. 11B is a side view illustrating the mechanical ventilation system 1100 in a lowered position, in accordance with an embodiment of the present disclosure. In particular, FIG. 11B illustrates when the front actuator portion 1116 and the rear actuator portion 1112 are in contact with the ground 1131. In such an example, the movable part 1102 can be pushed upward by the ground 1131 such that the air reservoir between the movable part 1102 and the substantially rigid surface 1104 is substantially eliminated, causing air to flow out of the exhaust opening 1118.

In some embodiments, when the movable part 1102 is pushed upward by the ground 1131, the elastic elements 1120, 1124 can be compressed. The elastic elements 1120, 1124 can be compressed without a foot of a user noticing the compression. In other embodiments, as described above, the mechanical ventilation system 1100 might not include the elastic elements 1120, 1124. In such embodiments, the movable part 1102 can be influenced by gravity.

In embodiments with the movable part 1102 facing in a downward direction, as shown in FIGS. 11A and 11B, the movable part 1102 can still operate similarly to FIGS. 3A-3E during a stepping motion. A difference can include that a force is being applied to the movable part from the ground 1131 rather than from a foot of a user.

Figure 12:
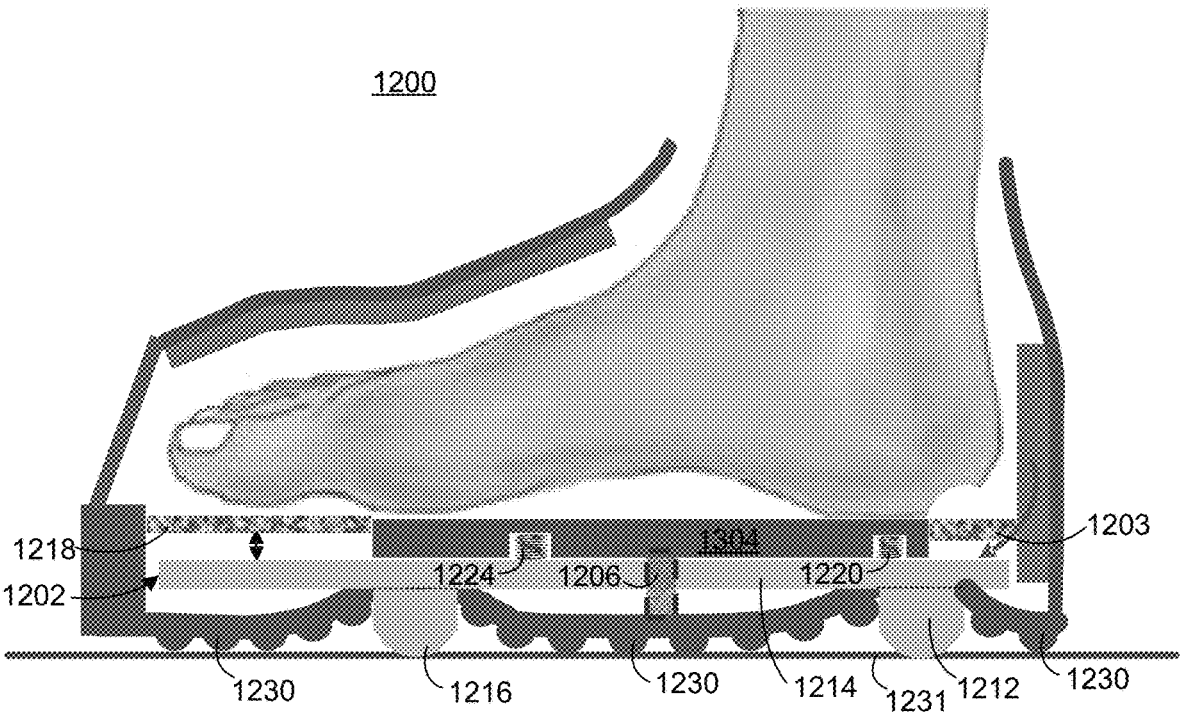
FIG. 12 is a side view illustrating another example of a mechanical ventilation system for footwear in a lowered position, in accordance with an embodiment of the present disclosure.

FIG. 12 is a side view illustrating an example of a mechanical ventilation system 1200 for footwear in a lowered position, in accordance with an embodiment of the present disclosure. The mechanical ventilation system 1200 can perform similarly to FIGS. 11A and 11B. However, rather than the sole 1130 being flat, as shown in FIGS. 11A and 11B, a front actuator portion 1216 can fit through a first open hole in a flexible sole 1230, and a rear actuator portion 1212 can fit through a second open hole in the flexible sole 1230. In some examples, the flexible sole 1230 can couple to one or more actuators to make the flexible sole 1230 waterproof, or at least water resistant. In particular, a first portion and a second portion of the flexible sole 1230 that are on each side of the front actuator portion 1216 can be coupled, or bonded such as to resist water, to the front actuator portion 1216 to create a seal between the flexible sole 1230 and the front actuator portion 1216. In addition, a first portion and a second portion of the flexible sole 1230 that are on each side of the rear actuator portion 1212 can be coupled, or bonded such as to resist water, to the rear actuator portion 1212 to create a seal between the flexible sole 1230 and the rear actuator portion 1212.

To facilitate movement of a movable part 1202, which includes the front actuator portion 1216 and the rear actuator portion 1212, the flexible sole 1230 can be a flexible, or semi-rigid, material such as a thermoplastic elastomer (e.g., NinjaFlex) or other suitable material. In such embodiments, because of the flexibility of the flexible sole 1230, portions of the flexible sole 1230 near the front actuator portion 1216 and the rear actuator portion 1212 can move with the actuators 1216, 1212. In some embodiments, the front actuator portion 1216, the rear actuator portion 1212, and the flexible sole 1230 can comprise the same material or can be separate materials.

In some embodiments, the mechanical ventilation system 1200 can include one or more elastic elements (e.g., elastic elements 1220, 1224). In other embodiments, the mechanical ventilation system 1200 might not include one or more elastic elements because the flexible sole 1230 can perform a similar function of opening an air intake opening and closing an air exhaust opening of an air reservoir located between a movable part 1202 and a substantially rigid surface 1304.

Figure 13A:
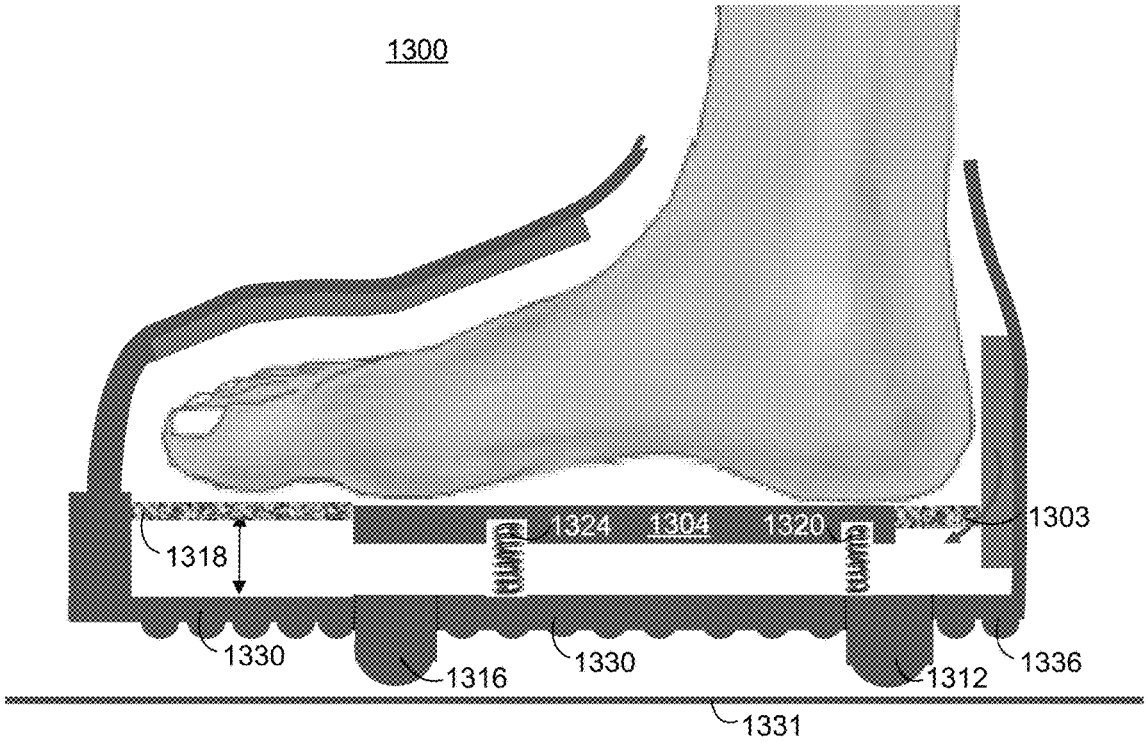
FIG. 13A is a side view illustrating another example of a mechanical ventilation system for footwear in a raised position, in accordance with an embodiment of the present disclosure.

FIG. 13A is a side view illustrating an example of a mechanical ventilation system 1300 for footwear in a raised position, in accordance with an embodiment of the present disclosure. Rather than including a separate movable part (as described in the embodiments above), the mechanical ventilation system 1300 can incorporate the movable part into a sole (which can include a front sole portion 1332, a middle sole portion 1334, back sole portion 1336, a front actuator portion 1316, and a rear actuator portion 1312). In such embodiments, even though the movable part is not a separate piece, the functionality can remain similar. For example, an air reservoir can be created between the sole and a substantially rigid surface 1304 while the footwear is off a ground 1331. In such an example, a portion of the sole can function as described above for the movable part.

In some embodiments, a flexibility of the sole can vary along a length of the sole. For example, the middle sole portion 1334, between the front actuator portion 1316 and the rear actuator portion 1312, can be rigid, similar to the movable part mentioned above. In addition, the front sole portion 1332 of the sole, in front of the front actuator portion 1316 (toward a front of the footwear) and the back sole portion 1336, behind of the rear actuator portion 1312 (toward a back of the footwear), can be flexible to allow the sole to move as the movable part would move in FIG. 12. A benefit of incorporating the movable part into the sole is that the air reservoir between the sole and the substantially rigid surface 1304 can be enlarged as compared to when a movable part is also included.

Again, the mechanical ventilation system 1300 illustrates one or more elastic elements (e.g., elastic elements 1324, 1320); however, the mechanical ventilation system 1300 can operate without an elastic element.

Figure 13B:
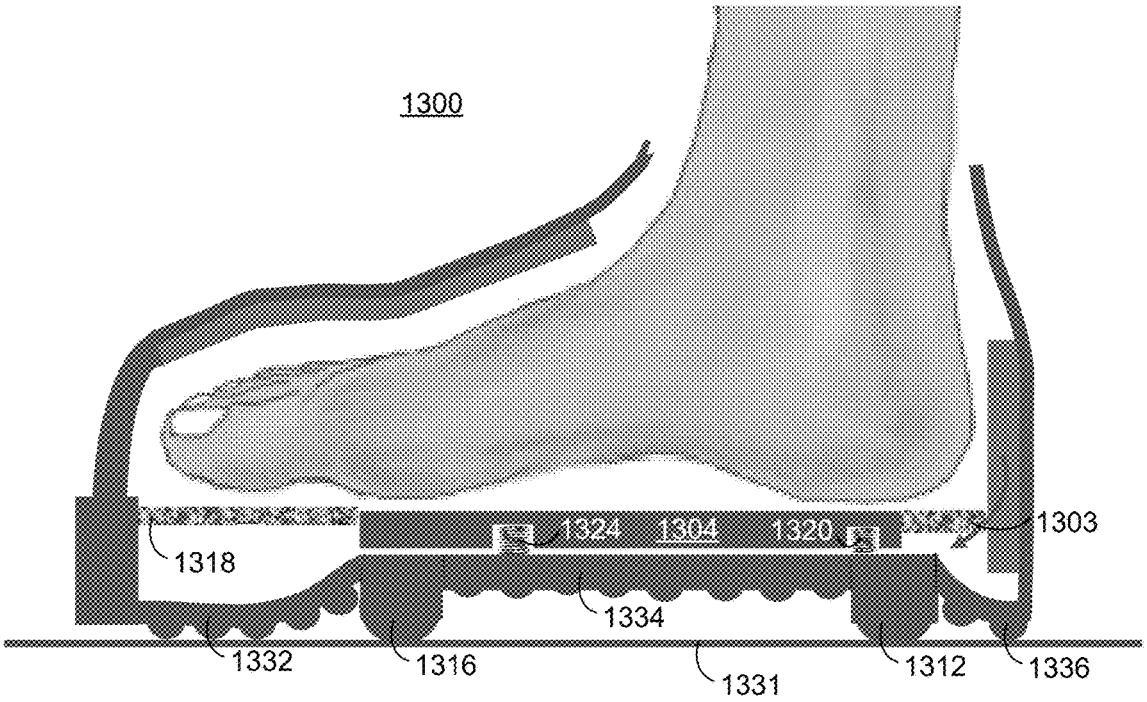
FIG. 13B is a side view illustrating another example of a mechanical ventilation system for footwear in a lowered position, in accordance with an embodiment of the present disclosure.

FIG. 13B is a side view illustrating the mechanical ventilation system 1300 in a lowered position, in accordance with an embodiment of the present disclosure. As can be seen, the front sole portion 1332 of the sole, which is in front of the front actuator portion 1316 (toward a front of the footwear), is flexible enough to bend such that a front region of the front sole portion 1332 is touching the ground 1331 while a back region of the front sole portion 1332 coupled to the front actuator portion 1316 is not touching the ground 1331. The back sole portion 1336 of the sole 1330, which is behind the rear actuator portion 1312 (toward a back of the footwear), can operate similarly as the front sole portion 1332, with a back region of the back sole portion 1336 touching the ground 1331 while a front region of the back sole portion 1336 coupled to the rear actuator portion 1312 is not touching the ground 1331.

In some embodiments, the middle sole portion 1334 of the sole that is between the front actuator portion 1316 and the rear actuator portion 1312 can be rigid, similar to the movable part discussed above. By being rigid, the middle sole portion 1334 can eliminate an air reservoir between the sole and a substantially rigid surface 1304 when the mechanical ventilation system 1300 is in the lowered position, in which case the middle sole portion 1334 is raised in an upward direction toward the substantially rigid surface 1304. In some embodiments, the front actuator portion 1316 and the rear actuator portion 1312 can protrude from the sole a length equal to a height of the air reservoir or other suitable height.

Figure 14A:
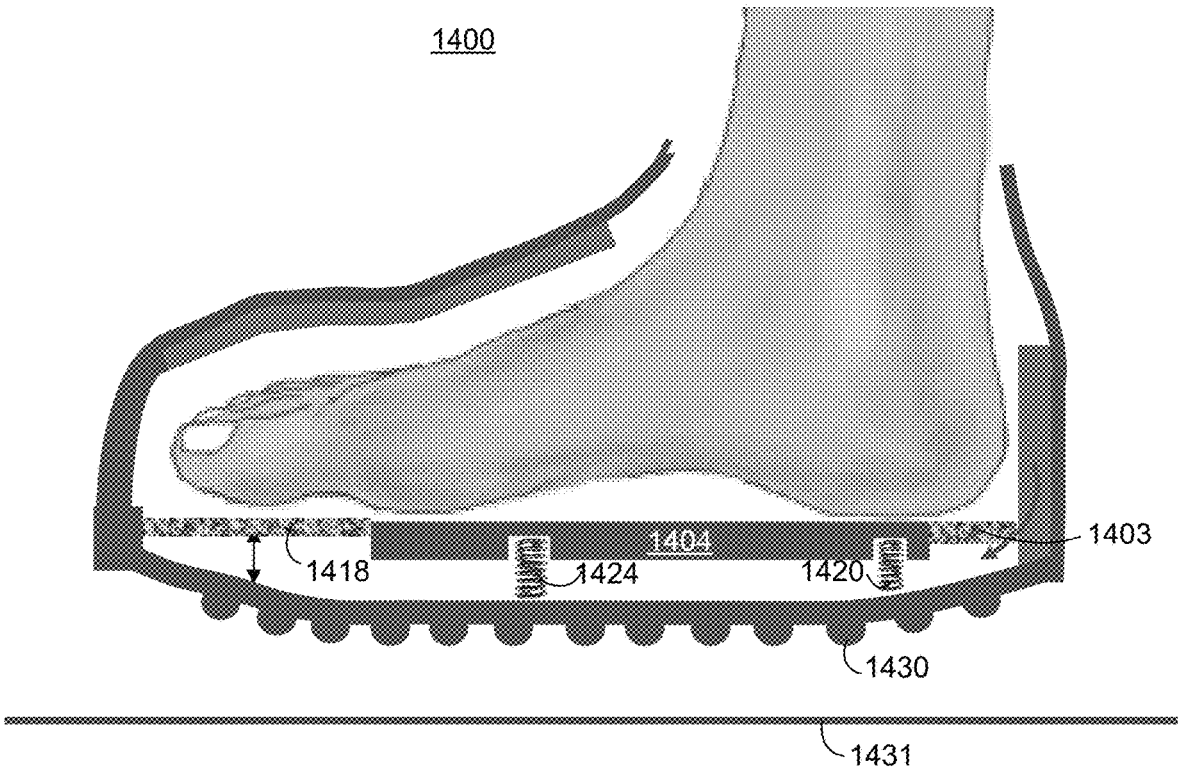
FIG. 14A is a side view illustrating another example of a mechanical ventilation system for footwear in a first (raised) position, in accordance with an embodiment of the present disclosure.

FIG. 14A is a side view illustrating an example of a mechanical ventilation system 1400 for footwear in a first (raised) position, in accordance with an embodiment of the present disclosure. In such an example, rather than having a front actuator portion and a rear actuator portion that protrude from a sole 1430 (as in some embodiments described above), the sole 1430 can be flexible such that an air reservoir between the sole 1430 and a substantially rigid surface 1404 can be filled and collapsed as if there were the front actuator portion and the rear actuator portion. In some embodiments, the sole 1430 can retain a convex shape when the shoe is lifted up in the first (raised) position. The convex shape can allow an increase in volume of the air reservoir. In some embodiments, a selective portion of the substantially rigid surface 1404 can be made semi-flexible to further increase or decrease air volume in an air reservoir when a user lifts up or steps on the footwear. If the sole 1430 is flexible and the substantially rigid surface 1404 is also flexible, the air reservoir can be compressed on top and bottom so that both parts share a portion of the vertical travel or deformation, and also the mechanical stress associated with the deformation of the flexible part.

In some embodiments, one or more elastic elements (e.g., elastic elements 1420, 1424) can be coupled to the sole 1430 and the substantially rigid surface 1404. The one or more elastic elements can maintain the air reservoir when the footwear is not on the ground by separating the sole 1430 from the substantially rigid surface 1404. In some embodiments, the one or more elastic elements can also maintain a shape of the sole 1430. For example, the one or more or more elastic elements can ensure that the sole 1430 does not excessively round underneath the footwear. In other embodiments, the mechanical ventilation system 1400 might not include the one or more elastic elements. In such embodiments, a motion of the sole 1430 can be influenced by gravity.

In some embodiments, the mechanical ventilation system 1400 can be combined with the multilayer design in FIGS. 9A and 9B.

Figure 14B:
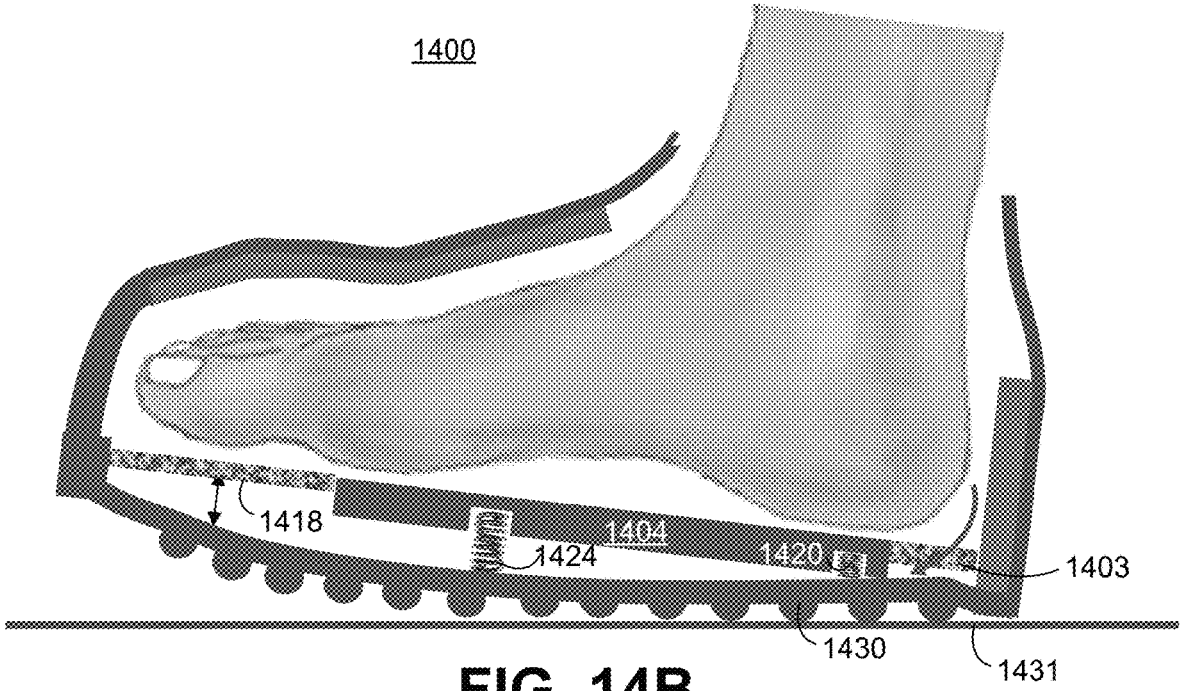
FIG. 14B is a side view illustrating another example of a mechanical ventilation system for footwear in a second position, in accordance with an embodiment of the present disclosure.

FIG. 14B is a side view illustrating the mechanical ventilation system 1400 in a second position, in accordance with an embodiment of the present disclosure. The second position represents a foot of a user heel striking a ground 1431. As a heel of the foot strikes the ground 1431, the sole 1430 can make contact with the ground 1431. The contact with the ground 1431 can cause an intake opening 1403 to be substantially closed off, forcing air through an air reservoir located between the sole 1430 and a substantially rigid surface 1404 upon which the foot rests. In some embodiments, the heel strike can cause a portion near the intake opening 1403 of the air reservoir to be eliminated, causing air to flow toward, and/or out of, the exhaust opening 1418.

In embodiments that include one or more elastic elements (e.g., elastic elements 1420, 1424), the heel strike can cause the elastic element 1420 to substantially compress, as shown in FIG. 14B. The elastic element 1424 can remain substantially uncompressed when the heel, and not the rest of the footwear, is striking the ground 1431. In other embodiments, the mechanical ventilation system 1400 can allow gravity to manipulate the sole 1430 without the use of one or more elastic elements.

Figure 14C:
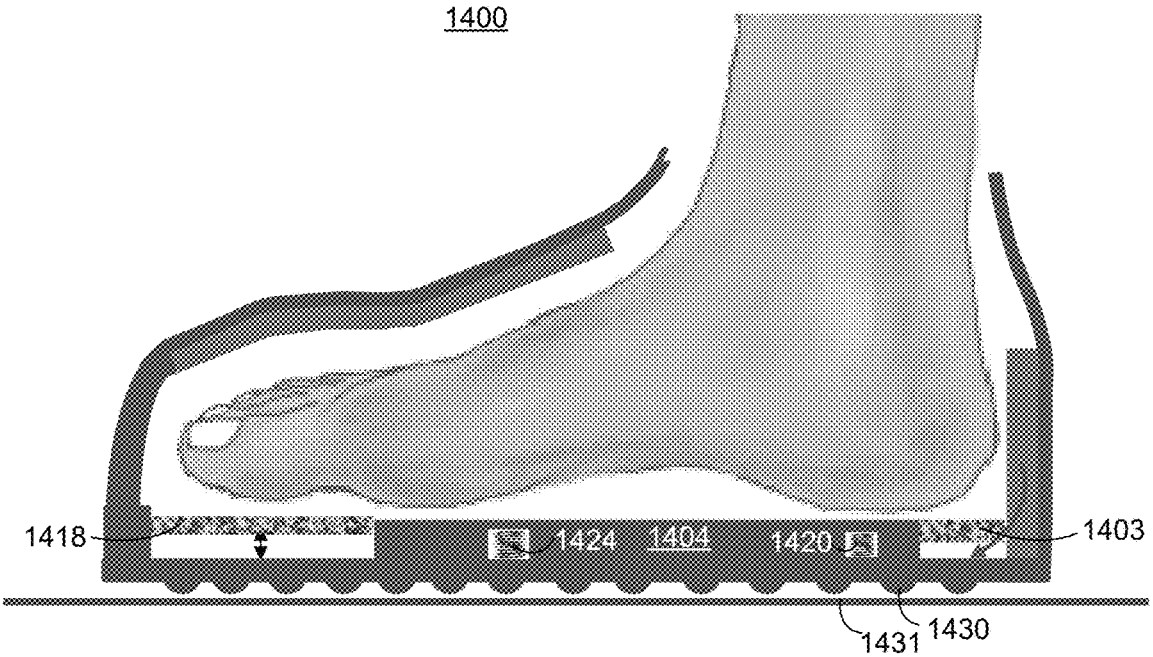
FIG. 14C is a side view illustrating another example of a mechanical ventilation system for footwear in a third (lowered) position, in accordance with an embodiment of the present disclosure.

FIG. 14C is a side view illustrating the mechanical ventilation system 1400 in a third (lowered) position, in accordance with an embodiment of the present disclosure. In such a position, a sole 1430 can be resting, or touching, the ground 1431. In some embodiments, the sole 1430 can conform to the ground 1431 due to a flexibility of the sole 1430. As shown in FIG. 14C, the one or more elastic elements (e.g., elastic elements 1420, 1424) can be compressed when the mechanical ventilation system 1400 is in the third position, allowing the sole 1430 and the substantially rigid surface 1404 to come into contact. In such embodiments, the air reservoir located between the sole 1430 and the substantially rigid surface 1404 can be reduced or temporarily eliminated, which expels any remaining air in the air reservoir through an exhaust opening 1418.

Figure 14D:
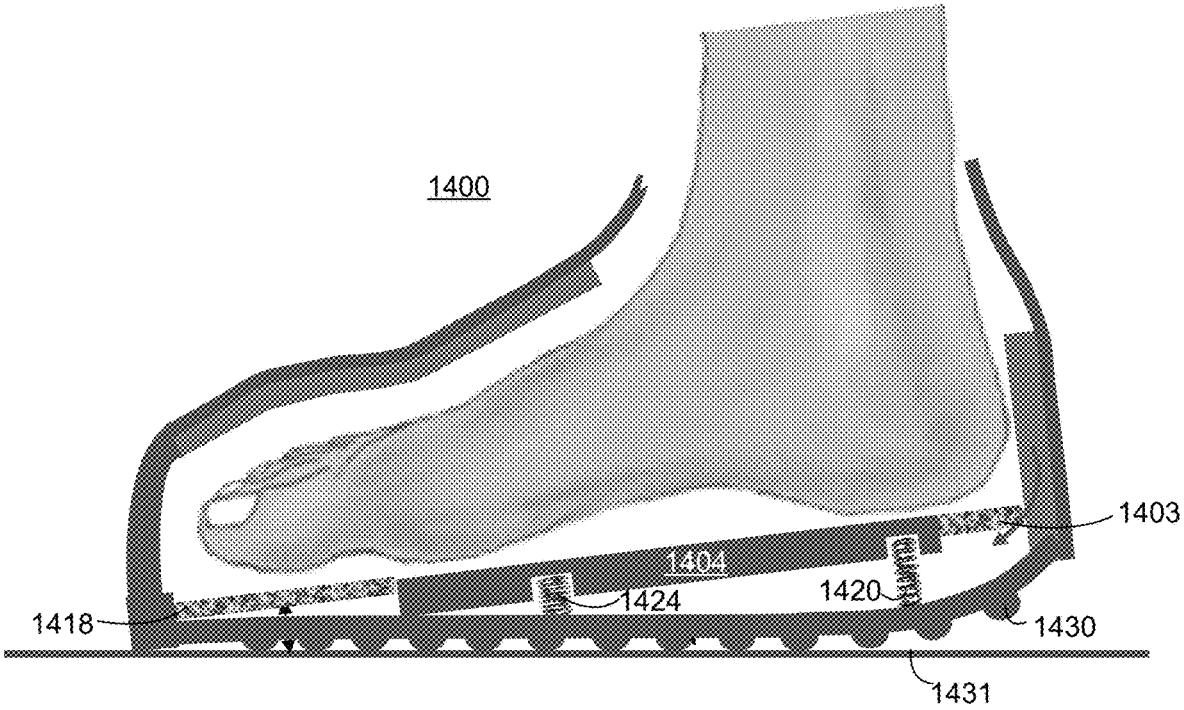
FIG. 14D is a side view illustrating another example of a mechanical ventilation system for footwear in a fourth position, in accordance with an embodiment of the present disclosure.

FIG. 14D is a side view illustrating the mechanical ventilation system 1400 in a fourth position, in accordance with an embodiment of the present disclosure. The fourth position includes a position in which the foot is raised from the ground 1431. In the fourth position, the sole 1430 and the substantially rigid surface 1404 begin to separate as the one or more elastic elements (e.g., elastic elements 1420, 1424) exert force on the sole 1430, allowing the air reservoir between the sole 1430 and the substantially rigid surface 1404 to at least partially fill with air entering through the intake opening 1403. In some embodiments, an exhaust opening 1418 can be closed off while in the fourth position. When the exhaust opening 1418 is closed off, air collected in the air reservoir through the intake opening 1403 is not allowed to escape through the exhaust opening 1418.

In some embodiments, at least a portion of the sole 1430 can maintain contact with the ground 1431 when a heel of the foot has been picked up by a user. As the user then raises the front of the foot, the mechanical ventilation system 1400 returns to the first (raised) position, where the entire foot is lifted as shown in FIG. 14A, and the reservoir is fully opened to allow air to fill the reservoir. FIGS. 14A, 14B, 14C, and 14D together illustrate a peristaltic compression of the air reservoir by the flexible sole to move the air from the intake to the exhaust, to ventilate the shoe with fresh air when the user is walking or running.

Figure 15A:
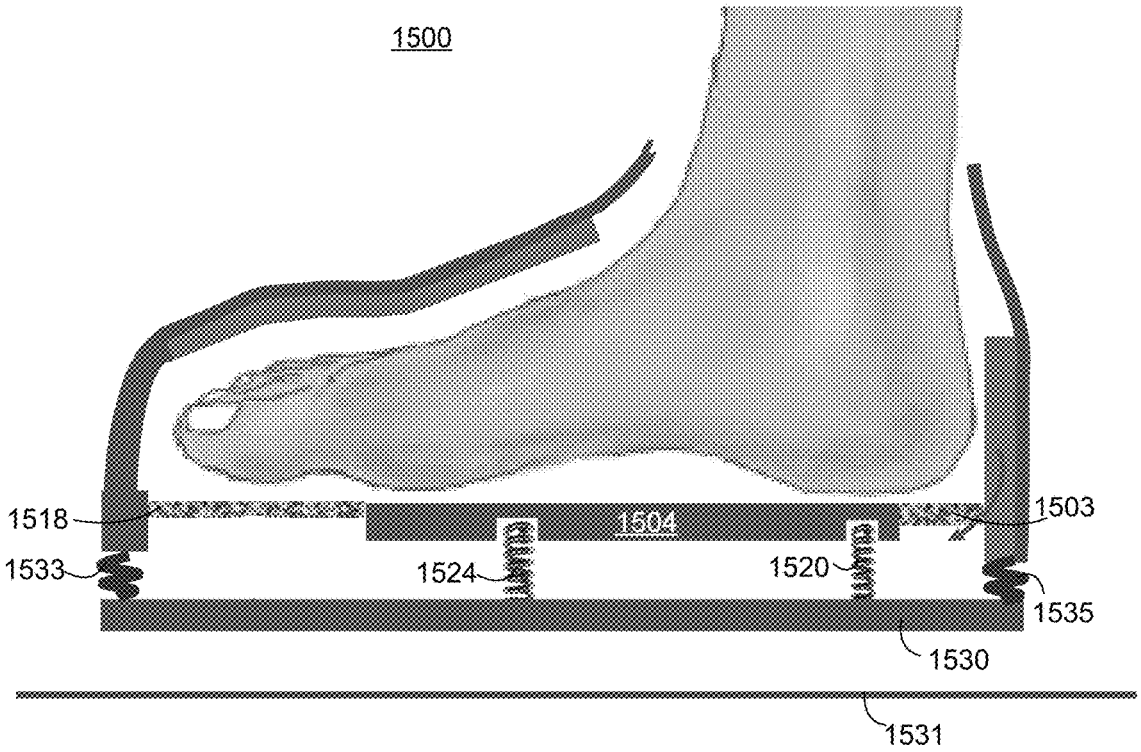
FIG. 15A is a side view illustrating another example of a mechanical ventilation system for footwear in a first (raised) position, in accordance with an embodiment of the present disclosure.

FIG. 15A is a side view illustrating an example of a mechanical ventilation system 1500 for footwear in a raised position, in accordance with an embodiment of the present disclosure. Rather than a sole being semi-flexible, a sole 1530 of the mechanical ventilation system 1500 can be attached to footwear using sidewall connectors 1533, 1535. The sidewall connectors 1533, 1535 can be vertically flexible or semi flexible. The sidewall connectors can be located at a front of the footwear, a rear of the footwear, a side of the footwear, any combination thereof, or any other suitable location of the footwear.

In some embodiments, the sole 1530 can be substantially rigid. The sole 1530 can be coupled to one or more elastic elements (e.g., elastic elements 1524, 1520). The one or more elastic elements can also be coupled to a substantially rigid surface 1504. The substantially rigid surface 1504 can provide support for a foot of a user, as described herein.

In some embodiments, an air reservoir can be created between the substantially rigid surface 1504 and the sole 1530. While in the raised position, the mechanical ventilation system 1500 can allow air to fill the air reservoir through an intake opening 1503. In addition, air can flow from the air reservoir through an exhaust opening 1518.

Figure 15B:
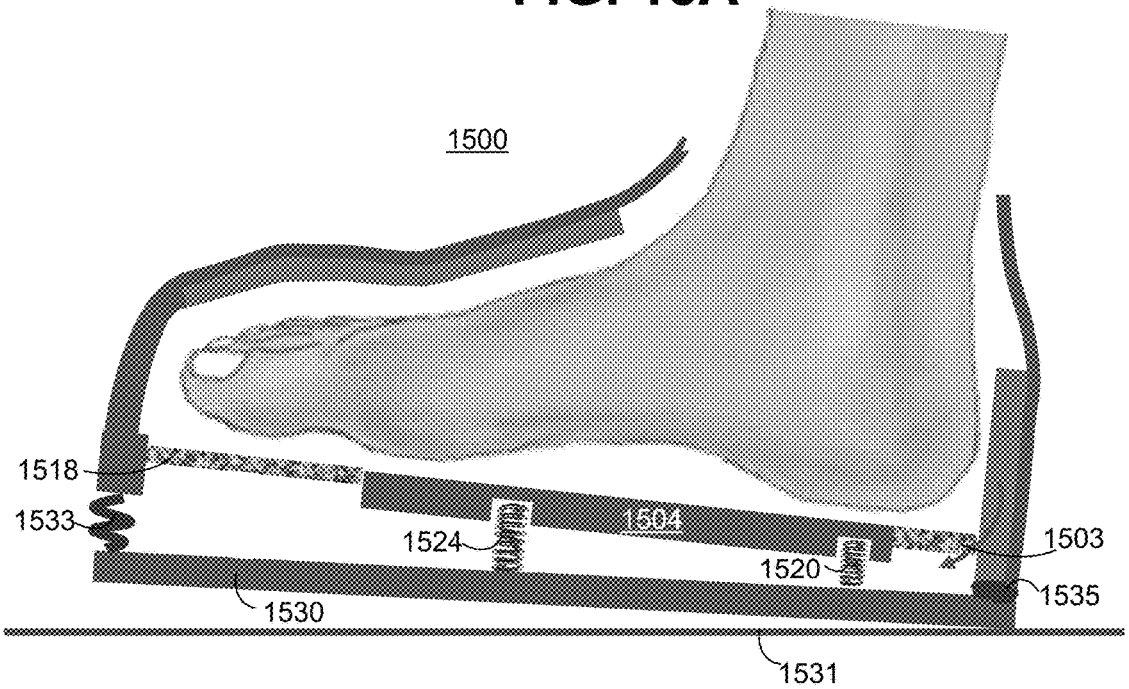
FIG. 15B is a side view illustrating another example of a mechanical ventilation system for footwear in a second position, in accordance with an embodiment of the present disclosure.

FIG. 15B is a side view illustrating the mechanical ventilation system 1500 in a second position, in accordance with an embodiment of the present disclosure. In the second position, a user can drop a back portion of the foot to a ground 1531. By dropping the foot, the mechanical ventilation system 1500 can substantially block off an intake opening 1503 such that new air is closed off from entering the air reservoir. In addition, air in the air reservoir can be pushed toward and out of an exhaust opening 1518. In some embodiments, a rear sidewall connector 1535 can compress in the second position. In such embodiments, a forward sidewall connector 1533 can remain substantially uncompressed.

Figure 15C:
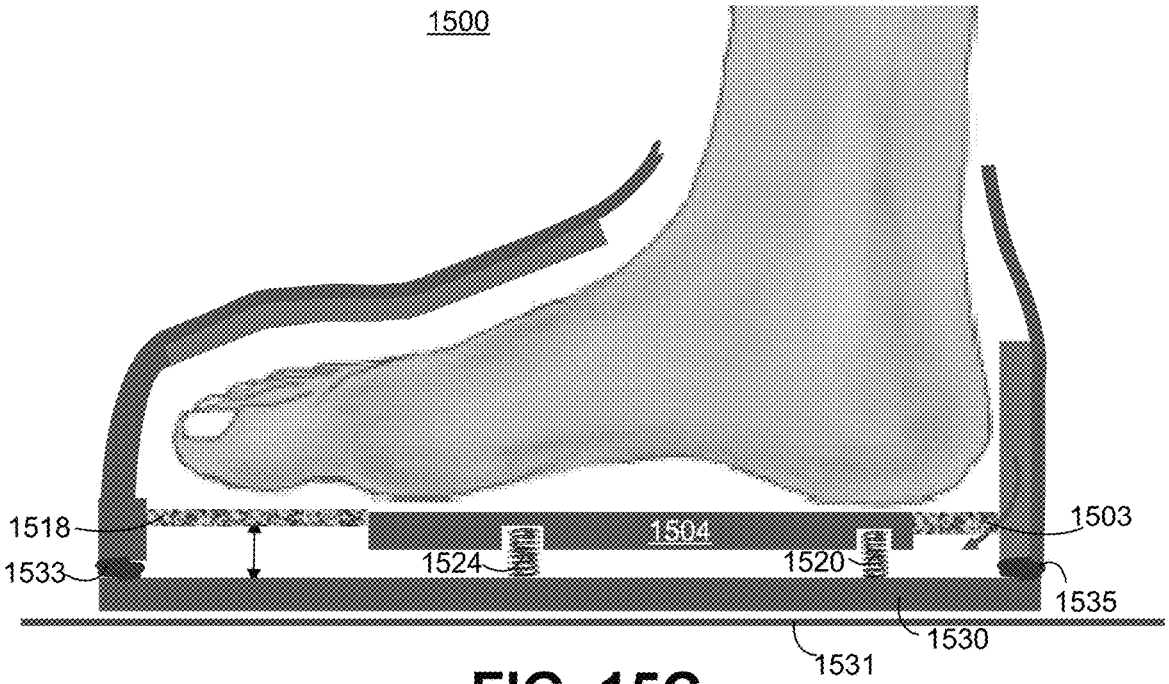
FIG. 15C is a side view illustrating another example of a mechanical ventilation system for footwear in a third (lowered) position, in accordance with an embodiment of the present disclosure.

FIG. 15C is a side view illustrating the mechanical ventilation system 1500 in a third (lowered) position, in accordance with an embodiment of the present disclosure. In the third position, both a rear sidewall connector 1535 and a forward sidewall connector 1533 can be compressed. When the sidewall connectors 1533, 1535 are compressed, the sole 1530, which is coupled to the sidewall connectors 1533, 1535, can be pushed closer to the substantially rigid surface 1504. In being pushed closer to the substantially rigid surface 1504, the sole 1530 can eliminate a portion of an air reservoir that is between the sole 1530 and the substantially rigid surface 1504. When the air reservoir is partially eliminated, air can be pushed from a back of the footwear, near an intake opening 1503, toward and out of an exhaust opening 1518.

In some embodiments, the sole 1530 can be pushed toward the substantially rigid surface 1504 by the ground 1531. In particular, the force of the footwear and the user's weight against the ground can compress the sidewall connectors 1533, 1535 such that the sole 1530 is pushed toward the substantially rigid surface 1504. In some embodiments, a foot of the user can still rest on the substantially rigid surface 1504.

Figure 15D:
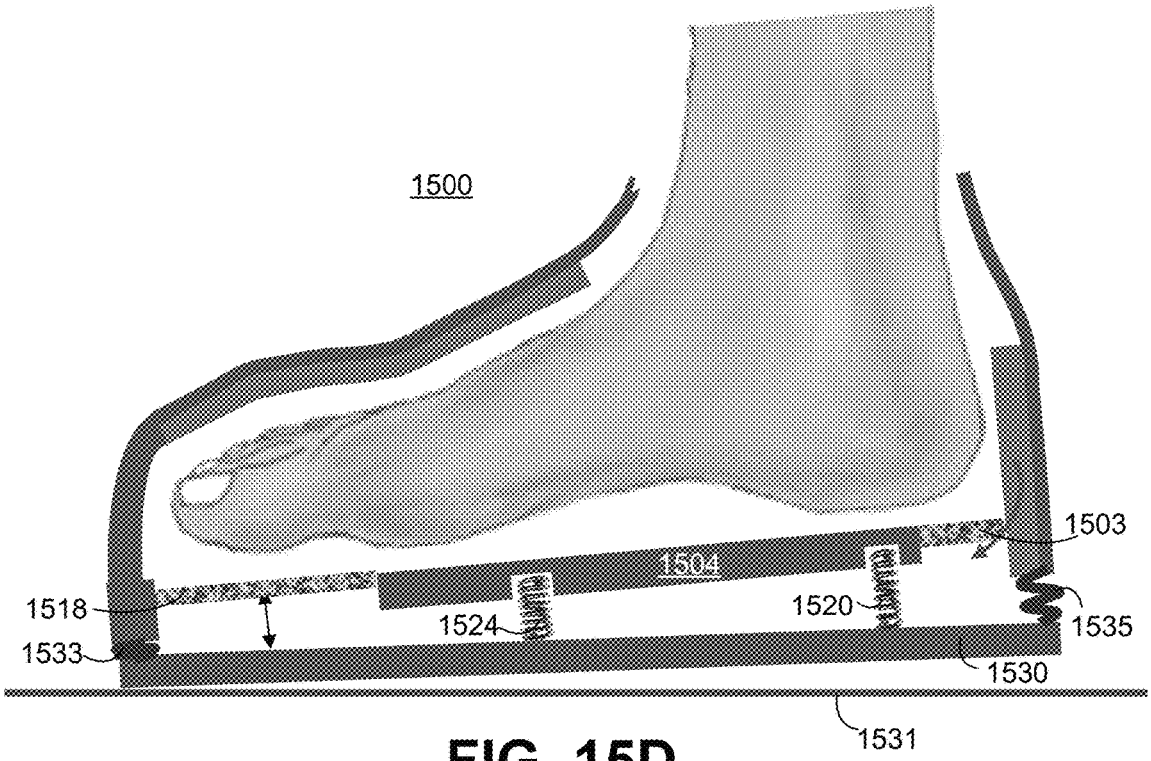
FIG. 15D is a side view illustrating another example of a mechanical ventilation system for footwear in a fourth position, in accordance with an embodiment of the present disclosure.

FIG. 15D is a side view illustrating the mechanical ventilation system 1500 for footwear in a fourth position, in accordance with an embodiment of the present disclosure. In the fourth position, a heel of a foot can be lifted such that a rear sidewall connector 1535 is at least partially uncompressed. In such an example, the air reservoir between a sole 1530 and the substantially rigid surface 1504 is enlarged, allowing air to flow in through the intake opening 1503.

In some embodiments, the forward sidewall connector 1533 can be compressed when the mechanical ventilation system 1500 is in the fourth position. The forward sidewall connector 1533 can cause an exhaust opening 1518 to be substantially closed off to the air reservoir, allowing air to remain in the air reservoir without escaping through the exhaust opening 1518.

Figure 16:
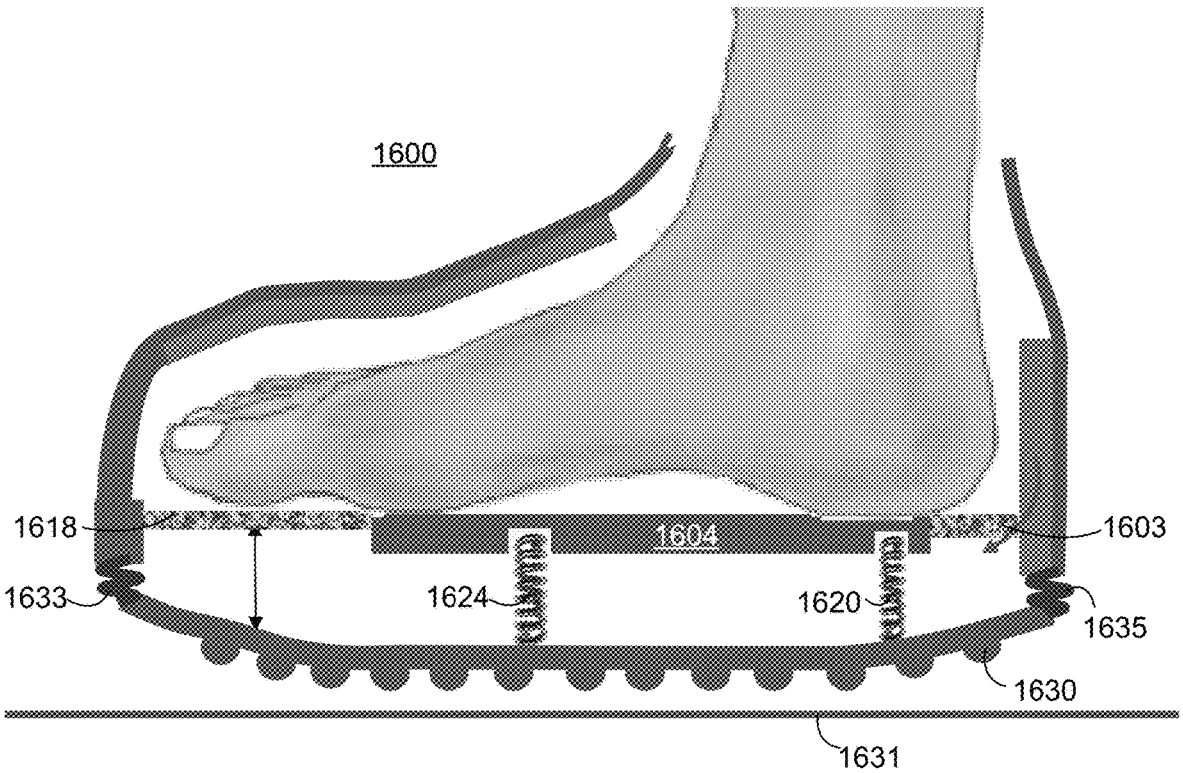
FIG. 16 is a side view illustrating another example of a mechanical ventilation system for footwear that combines other embodiments, in accordance with an embodiment of the present disclosure.

FIG. 16 is a side view illustrating another example of a mechanical ventilation system 1600 for footwear that combines other embodiments, in accordance with an embodiment of the present disclosure. An advantage of combining a flexible sole with a flexible sidewall is to share the stress caused by the flexible sole. For example, a flexible sole connected to a rigid sidewall can induce a lot of stress on the sole region that is connected to the rigid sidewall. The stress can be caused because the sole must bear all of the stress in such situations. If the side wall is also flexible, then it can be designed to relieve the stress caused by the flexible sole. In some examples, the sidewall and the sole can be one flexible piece, such that there is no clear distinction between the sidewall and the sole.

The mechanical ventilation system 1600 can include embodiments described in FIGS. 14A-14D and 15A-15D. For example, the mechanical ventilation system 1600 can include a flexible sole 1630. The flexible sole 1630 can function as a movable part would during a walking motion, as described with FIGS. 14A-14D.

The mechanical ventilation system 1600 can also include a front sidewall connector 1633 and a back sidewall connector 1635. In other embodiments, the sidewall connectors can be located in the front of the footwear, the back of the footwear, the side of the footwear, any combination thereof, or other suitable location. The sidewall connectors can be flexible or semi-flexible. By adding the two embodiments together, the mechanical ventilation system 1600 can obtain additional compression and expansion of an air reservoir between the flexible sole 1630 and a substantially rigid surface 1604.

Figure 17:
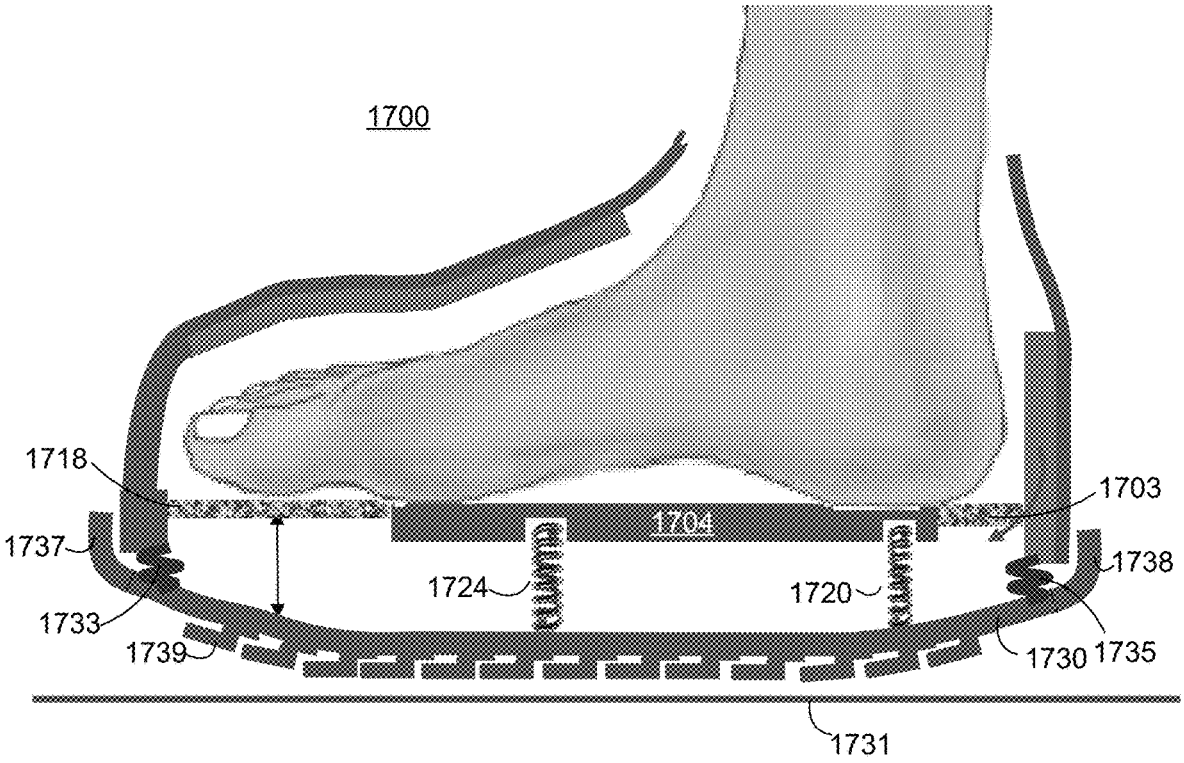
FIG. 17 is a side view illustrating another example of a mechanical ventilation system for footwear with alterations to a sole, in accordance with an embodiment of the present disclosure.

FIG. 17 is a side view illustrating another example of a mechanical ventilation system 1700 for footwear with alterations to a sole 1730, in accordance with an embodiment of the present disclosure. While the alterations to the sole 1730 are shown using a mechanical ventilation system similar to the mechanical ventilation system 1600, a person of ordinary skill in the art will recognize that the alterations can be made to any mechanical ventilation system described herein.

In some embodiments, the sole 1730 can include one or more protective regions 1739. The one or more protective regions 1739 can be made to be thicker or extended over portions of the sole 1730 that are thin and/or flexible. In some embodiments, the one or more protective regions 1739 can be coupled to the sole 1730 in places that are not thin so as to keep the thin regions flexible. By including the one or more protective regions 1739, the one or more protective regions 1739 can be worn down instead of the sole 1730. In some embodiments, the protective regions 1739 can be made with a more durable material (e.g., an engineering plastic such as polyether ether ketone (PEEK), a ceramic such as alumina, or other durable material). In some embodiments, the protective regions can be made to be user replaceable.

In some embodiments, the sole 1730 can include sidewall covers (e.g., front sidewall cover 1737 and back sidewall cover 1738). The sidewall covers can protect a sidewall connector (e.g., front sidewall connector 1733 and back sidewall connector 1735) from wear. In such examples, the sole 1730 can be more prone to wear because the sole 1730 is made flexible. The advantage of the various covers is to protect the flexible sole. The sole can be flexible not only by a choice of material, but also by making the material relatively thin.

Figure 18:
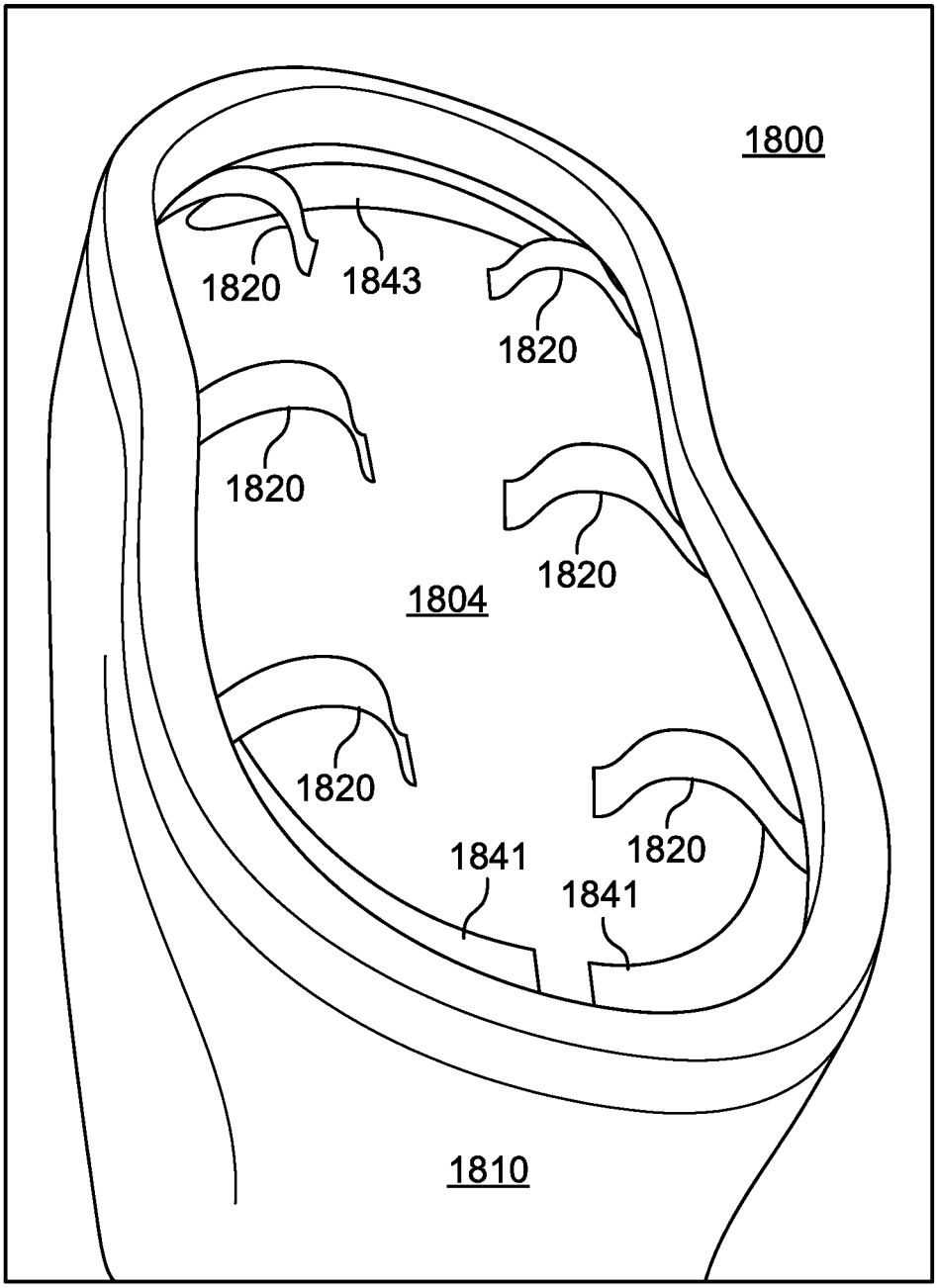
FIG. 18 is a bottom view illustrating an example of compressible elements for a mechanical ventilation system, in accordance with an embodiment of the present disclosure.

FIG. 18 is a bottom view illustrating an example of compressible elements for a mechanical ventilation system 1800, in accordance with an embodiment of the present disclosure. The mechanical ventilation system includes an outer shoe layer 1810 (as discussed above), a vertical wall 1843 (to create an air reservoir), and a flexible shoe bottom (not shown). The three components mentioned can be coupled together to create a footwear. For example, the upper part 1810 can be blued onto the vertical wall 1843 and the vertical wall 1843 can be glued onto the flexible shoe bottom layer. In one illustrative example, the vertical wall 1843 can be 8 millimeters tall. In such an example, the air reservoir can include the entire shoe bottom inside of the 8 mm tall vertical wall 1843.

As described above, the outer shoe layer 1810 can include one or more back holes 1841 and one or more front holes 1843. The mechanical ventilation system 1800 can further include one or more elastic elements 1820 (e.g., compressible components to facilitate movement of the flexible shoe bottom). As can be seen in FIG. 18, the one or more elastic elements 1820 can be located on the underside, or bottom, of a foot bed where a foot of the user rests their foot. A person of ordinary skill in the art will recognize that FIG. 18 is only an example of a configuration of the one or more elastic elements 1820, and that the one or more elastic elements 1820 can be arranged in any way on the foot bed.

In one illustrative example, an elastic element can be a leaf spring (as shown in FIG. 18). An advantage of the leaf spring is its low profile thickness when fully compressed. In some examples, the leaf springs can be made of Beryllium Copper. The Beryllium Copper can allow the leaf springs to retain springiness after many cycles of compression and relaxation. However, a person of ordinary skill in the art will recognize that the elastic elements can be different materials and/or different types.

In the foregoing specification, aspects of the invention are described with reference to specific embodiments thereof, but those skilled in the art will recognize that the invention is not limited thereto. Various features and aspects of the above-described invention may be used individually or jointly. Further, embodiments can be utilized in any number of environments and applications beyond those described herein without departing from the broader spirit and scope of the specification. The specification and drawings are, accordingly, to be regarded as illustrative rather than restrictive.

In the foregoing description, for the purposes of illustration, methods were described in a particular order. It should be appreciated that in alternate embodiments, the methods may be performed in a different order than that described.

Where components are described as being configured to perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

In addition, other components may be added to, or removed from, the described systems. Accordingly, other implementations are within the scope of the following claims.

Where components are described as being configured to perform certain operations, such configuration can be accomplished, for example, by designing the components to operate in a certain way when an action is performed, such as when a user takes a step.

While illustrative embodiments of the application have been described in detail herein, it is to be understood that the inventive concepts may be otherwise variously embodied and employed, and that the appended claims are intended to be construed to include such variations, except as limited by the prior art.

What is claimed is:

1. A mechanical ventilation system for footwear, comprising: a substantially rigid surface configured to support at least a portion of a foot; a movable part comprising:

a front actuator portion positioned at a front portion of the footwear, the front actuator portion being compressible in a first direction and extending at least partially through a first opening in the substantially rigid surface;

a rear actuator portion positioned at a rear portion of the footwear, the rear actuator portion being compressible in the first direction and extending at least partially through a second opening in the substantially rigid surface; and an extension piece located at least partially under the substantially rigid surface, the extension piece connecting the front actuator portion to the rear actuator portion;

an elastic element coupled to the movable part, the elastic element being configured to push the front actuator portion and the rear actuator portion in a second direction; and an air reservoir including an air intake opening and an air exhaust opening;

wherein when the rear actuator portion is compressed in the first direction, the extension piece overcomes a force of the elastic element to cause the extension piece to move in the first direction, forcing air out of the air exhaust opening of the air reservoir.

2. The mechanical ventilation system of claim 1, wherein the air reservoir is defined by the substantially rigid surface and a sole of the footwear.

3. The mechanical ventilation system of claim 1, wherein a repetitive compression and decompression of the front actuator portion and the rear actuator portion ventilates a foot compartment of the footwear by a flow of air into the air intake opening and out of the air exhaust opening.

4. The mechanical ventilation system of claim 1, wherein when the rear actuator portion is compressed in the first direction, the front actuator portion is moved in the second direction.

5. The mechanical ventilation system of claim 1, wherein when the front actuator portion is compressed in the first direction, the extension piece overcomes a force of the elastic element to cause the rear actuator portion to move in the second direction, allowing air to enter into the air intake opening of the air reservoir.

6. The mechanical ventilation system of claim 5, wherein the second direction is an upward direction, the elastic element being configured to raise the front actuator portion and the rear actuator portion in the upward direction.

7. The mechanical ventilation system of claim 6, wherein the first direction is a downward direction.

8. The mechanical ventilation system of claim 1, wherein when the rear actuator portion is compressed in the first direction, the front actuator portion is compressed in the first direction.

9. The mechanical ventilation system of claim 1, wherein the movable part is configured to allow air to enter into the air intake opening of the air reservoir when the front actuator portion and the rear actuator portion are pushed in the second direction by the elastic element.

10. The mechanical ventilation system of claim 1, wherein the elastic element includes at least two elastic elements.

11. The mechanical ventilation system of claim 1, wherein the elastic element includes one or more springs.

12. The mechanical ventilation system of claim 1, wherein a portion of a sole of the footwear is flexible and configured to be deformable by a foot.

13. The mechanical ventilation system of claim 1, wherein the air exhaust opening includes at least one air-permeable surface.

14. The mechanical ventilation system of claim 1, wherein the air exhaust opening includes at least one open orifice.

15. The mechanical ventilation system of claim 1, wherein the air exhaust opening is a hollow conduit structure leading from a front opening of the air reservoir via a foot compartment of the footwear to outside of the footwear.

16. The mechanical ventilation system of claim 1, wherein the air intake opening includes at least one air-permeable surface.

17. The mechanical ventilation system of claim 1, wherein the air intake opening includes at least one open orifice.

18. The mechanical ventilation system of claim 1, wherein the air intake opening is a hollow conduit structure leading from a rear opening of the air reservoir to outside of the footwear.

19. The mechanical ventilation system of claim 1, wherein the second opening in the substantially rigid surface includes the air intake opening.

20. The mechanical ventilation system of claim 1, wherein the first opening in the substantially rigid surface includes the air exhaust opening.

* * * * *